US005602351A

United States Patent [19]

Kawamura et al.

[11] Patent Number: 5,602,351

[45] Date of Patent: Feb. 11, 1997

[54] GRAND PIANO-LIKE KEYBOARD INSTRUMENT FOR SELECTIVELY PRODUCING ACOUSTIC SOUND AND SYNTHESIZED SOUND

[75] Inventors: Kiyoshi Kawamura; Yasutoshi Kaneko, both of Shizuoka, Japan

[73] Assignee: Yamaha Corporation, Japan

[21] Appl. No.: 174,179

[22] Filed: Dec. 27, 1993

[30] Foreign Application Priority Data

Nov. 30, 1993 [JP] Japan ..... 5-323437

[51] Int. Cl.[6] ..... G10D 15/00

[52] U.S. Cl. ..... 84/171; 84/220; 84/239

[58] Field of Search ..... 84/239, 240, 222, 84/171, 615, 170, 220, 219, 221, 223

[56] References Cited

U.S. PATENT DOCUMENTS

| | | | |
|---|---|---|---|
| 533,661 | 2/1894 | McChesney et al. | 84/171 |
| 537,533 | 10/1894 | McChesney et al. | 84/171 |
| 2,250,065 | 7/1941 | Koel | 84/171 |
| 4,633,753 | 1/1987 | Takahashi | 84/220 |
| 4,704,931 | 11/1987 | Nagai | 84/171 |
| 4,744,281 | 5/1988 | Isozaki | 84/615 |
| 4,970,929 | 11/1990 | Ishida | 84/220 |
| 5,001,339 | 3/1991 | Starkley et al. | 250/229 |
| 5,115,705 | 5/1992 | Monte et al. | 84/617 |
| 5,247,129 | 9/1993 | Nozaki et al. | 84/615 |
| 5,374,775 | 12/1994 | Kawamura et al. | 84/171 |

FOREIGN PATENT DOCUMENTS

| | | |
|---|---|---|
| 0270966A2 | 6/1988 | European Pat. Off. . |
| 0573963A2 | 12/1993 | European Pat. Off. . |
| 97885 | 10/1897 | Germany . |
| 44782 | 9/1898 | Germany . |
| 3707591C1 | 5/1988 | Germany . |
| T0910077 | 10/1992 | Italy . |
| 51-67732 | 5/1976 | Japan . |
| 55-55880 | 4/1980 | Japan . |
| 62-32308 | 8/1987 | Japan . |
| 63-97997 | 4/1988 | Japan . |

*Primary Examiner*—Cassandra C. Spyrou
*Attorney, Agent, or Firm*—Graham & James LLP

[57] ABSTRACT

A piano-like keyboard instrument allowing a player to perform in either an acoustic sound mode and or an electronic sound producing mode. In the electronic sound producing mode, a stopper blocks sets of piano strings from hammers and an electronic sound producing unit generates electronic sounds. A key touch is maintained in the electronic sound producing mode. A gap regulating unit changes gaps between the toes of jacks and regulating buttons, depending upon which mode of operation is selected. Hammer shanks rebound on the stopper after the escapes of the jacks.

7 Claims, 23 Drawing Sheets

GRAND PIANO-LIKE KEYBOARD INSTRUMENT FOR SELECTIVELY PRODUCING ACOUSTIC SOUND AND SYNTHESIZED SOUND

FIELD OF THE INVENTION

This invention relates to a grand piano-like keyboard instrument and, more particularly, to a grand piano-like keyboard instrument for selectively producing acoustic sounds and synthesized sounds.

DESCRIPTION OF THE RELATED ART

A typical example of a grand piano equipped with a muting mechanism is disclosed in Japanese Utility Model Publication of Unexamined Application (Kokai) No. 51-67732, and the muting mechanism restricts a hammer motion with an elastic member. Namely, when a player depresses a key, the associated hammer is driven for rotation toward a set of strings, and concurrently strikes the elastic member and the strings. Then, the elastic member takes up part of the kinetic energy of the hammer so that the sound is lessened. In other words, the elastic member aims at reduction of impact against the strings, and the muting mechanism gives rise to decrease of loudness of acoustic sounds.

Of course, if the elastic member is spaced farther from the strings, the elastic member blocks the strings from the hammer, and the hammer does not strike at the strings. However, the elastic member thus spaced father from the strings destructs the unique key-touch. Namely, when the hammer butt is escaped from the jack, the hammer head usually reaches a vicinity of the strings as close as 2 millimeters. If the elastic member is spaced farther, the hammer is liable to be brought into contact with the elastic member before the escape from the hammer butt, and the player feels the key-touch to be strange.

On the other hand, if a tuner advances the regulating button toward the jack, the hammer butt is escaped from the jack earlier, and the hammer is brought into contact with the elastic member after the escape from the jack. As a result, the escape gives a kind of key-touch to the player. However, the key-touch is still different from that of an acoustic piano, and the player feels the key-touch to be strange.

Moreover, when a player moves the elastic member out of the orbit of the hammer head for an ordinary performance, the jack merely give a weak rotational force to the butt due to the early escape, and the hammer head softly strikes the strings. The soft strike results in harpsichord-like sounds. Additionally, the motion of the hammer is slow, and weakly rebounds on the strings. This means that the hammer can not respond to a quick repetition.

Another prior art is disclosed in U.S. Pat. No. 2,250,065, and the keyboard disclosed in the United States Patent previously lifts the hammer assemblies for producing gaps between the jacks and the hammer rollers. However, the jacks do not escape from the hammer assemblies, and the key-touch is different from the unique piano key-touch.

SUMMARY OF THE INVENTION

It is therefore an important object of the present invention to provide a grand piano-like keyboard instrument which can enter into a silent mode without deterioration of a unique key touch in an acoustic sound mode.

To accomplish the object, the present invention changes a gap between a toe of each jack and an associated regulating button when switching between an acoustic sound mode and a silent mode such that a hammer rebounds on strings in the acoustic sound mode or a stopper in silent mode, after an escape of the jack.

In accordance with the present invention, there is provided a grand-piano like keyboard instrument selectively entering an acoustic sound producing mode and an electronic sound producing mode, comprising: a) a grand piano including a-1) a keyboard having a plurality of keys turnable with respect to a stationary board member, the plurality of keys being selectively depressed in both acoustic and electronic sound producing modes by a player, a-2) a plurality of key action mechanisms respectively coupled with the plurality of keys, and selectively actuated by the plurality of keys when the player depresses, each of the plurality of key action mechanisms having an action bracket stationary with respect to the stationary board member, an whippen assembly driven by one of the plurality of keys for rotation around one end thereof with respect to the action bracket, a repetition lever flange projecting from an intermediate portion of the whippen assembly, a repetition lever swingably supported by the repetition lever flange and having a through-hole formed in one end portion thereof, a jack rotatably supported by the other end of the whippen assembly and having a toe and a contact portion projecting through the through-hole, a regulating button supported by the action bracket and opposed to the toe, and a repetition spring for urging the repetition lever in a direction to increase a gap between the one end portion of the repetition level and the other end of the whippen assembly, a-3) a plurality of hammer mechanisms respectively associated with the plurality of key action mechanisms, and having respective hammer heads connected with hammer shanks respectively, and driven for rotation by the plurality of key action mechanisms when the player selectively depresses the plurality of keys, the hammer shank of each hammer mechanism being swingably supported by the action bracket of the associated key action mechanism and held in contact with the contact portion of the jack of the associated key action mechanism while the associated key is in a rest position, a-4) a plurality sets of strings associated with the plurality of hammer mechanisms, and stretched over the plurality of key action mechanisms, each set of strings being struck by the hammer head of the associated hammer mechanism in the acoustic sound producing mode when the player selectively depresses the plurality of keys; b) a stopper means entering into a free position in the acoustic sound mode for allowing the plurality of hammer mechanisms to strike the associated sets of strings when the player depresses the plurality of keys, the stopper means entering into a blocking position in the electronic sound producing mode for blocking the plurality sets of strings from the hammer mechanisms when the player selectively depresses the keys; c) a gap regulating means associated between the regulating button of each key action mechanism for changing the gap between the regulating button and the toe depending upon the mode when the associated key is in the rest position; and d) an electronic sound producing means monitoring the plurality of keys to see what keys are depressed by the player in the electronic sound producing mode, and operative to electronically produce sounds corresponding to the keys depressed by the player.

BRIEF DESCRIPTION OF THE DRAWINGS

The features and advantages of the grand piano-like keyboard instrument according to the present invention will be more clearly understood from the following description taken in conjunction with the accompanying drawings in which.

DESCRIPTION OF THE PREFERRED EMBODIMENTS

First Embodiment

Figure 1:
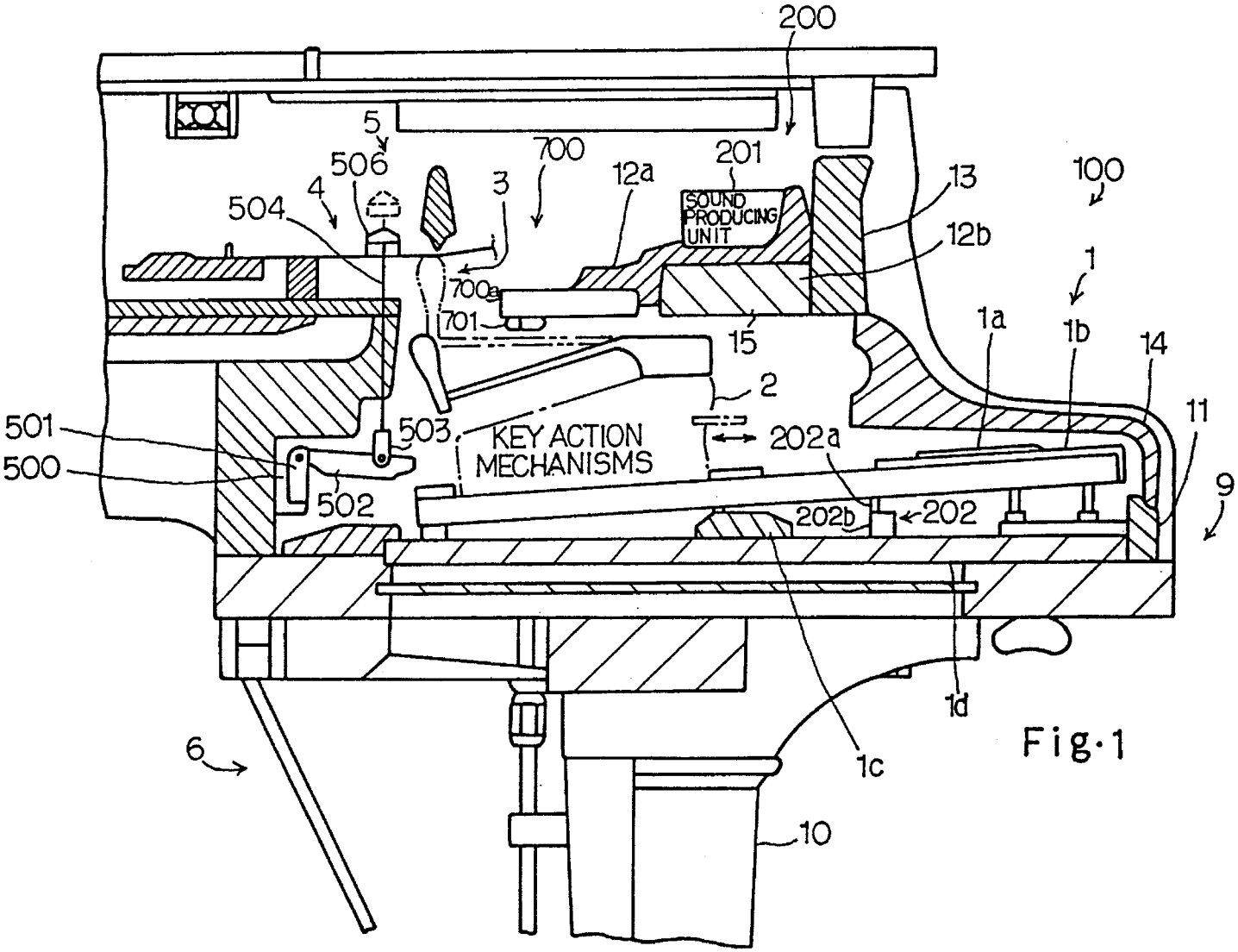
FIG. 1 is a cross sectional view showing the structure of a grand piano-like keyboard instrument according to the present invention.

Referring first to FIG. 1 of the drawings, a grand piano-like keyboard instrument embodying the present invention largely comprises an acoustic piano 100, an electronically sound generating system 200 and a mode controlling system 700, and selectively enters into an acoustic sound mode and a silent mode. A player performs music as if the keyboard instrument is a grand piano in the acoustic sound mode. While the grand piano-like keyboard instrument is in the silent mode, the mode controlling system allows a player to practice a fingering without sound or to perform an electronically produced music through the fingering. The electronic sound generation in the silent mode is referred to as an electronic sound producing sub-mode, and the silent mode without synthesized sounds is called as a true silent sub-mode.

In the following description, words "front" and "rear" are indicative of relative positions spaced from a player by short distance and by long distance, and words "clockwise" and "counter clockwise" are determined on the paper where the related structure is illustrated.

The acoustic piano 100 is similar to a grand piano, and largely comprises a keyboard 1, a plurality of key action mechanisms 2, a plurality of hammer assemblies 3, a plurality sets of strings 4, a plurality of damper assemblies 5 and a pedal mechanism 6.

The keyboard 1 is implemented by a plurality of black and white keys 1*a* and 1*b*, typically eighty-eight keys, rockable with respect to a balance rail 1*c* on a key bed 1*d*. The notes of a scale are respectively assigned to the black and white keys 1*a* and 1*b* as well as to the sets of strings 4, and each of the black and white keys 1*a* and 1*b* is swingable between a rest position and an end position. The black and white keys 1*a* and 1*b* are respectively linked with the key action mechanisms 2, and the key action mechanisms 2 are respectively associated with the hammer assemblies 3 and with the sets of strings 4. The black and white keys 1*a* and 1*b* are further associated with the damper assemblies 5, and the damper assemblies are driven by the associated black and white keys 1*a* and 1*b* on the way from the rest position to the end position.

When one of the black and white keys 1*a* and 1*b* is depressed, the associated key action mechanism 2 drives the associated hammer assembly 3 for rotation, and the hammer assembly 3 strikes at the associated set of strings. While the key is staying at the rest position, the damper assembly 5 is held in contact with the associated set of strings. However, while the key is moving toward the rest position, the key pushes the damper assembly 5, and leaves the damper assembly 5 from the associated set of strings 4, thereby allowing the set of strings 4 to vibrate upon strike with the hammer assembly 3.

Figure 2:
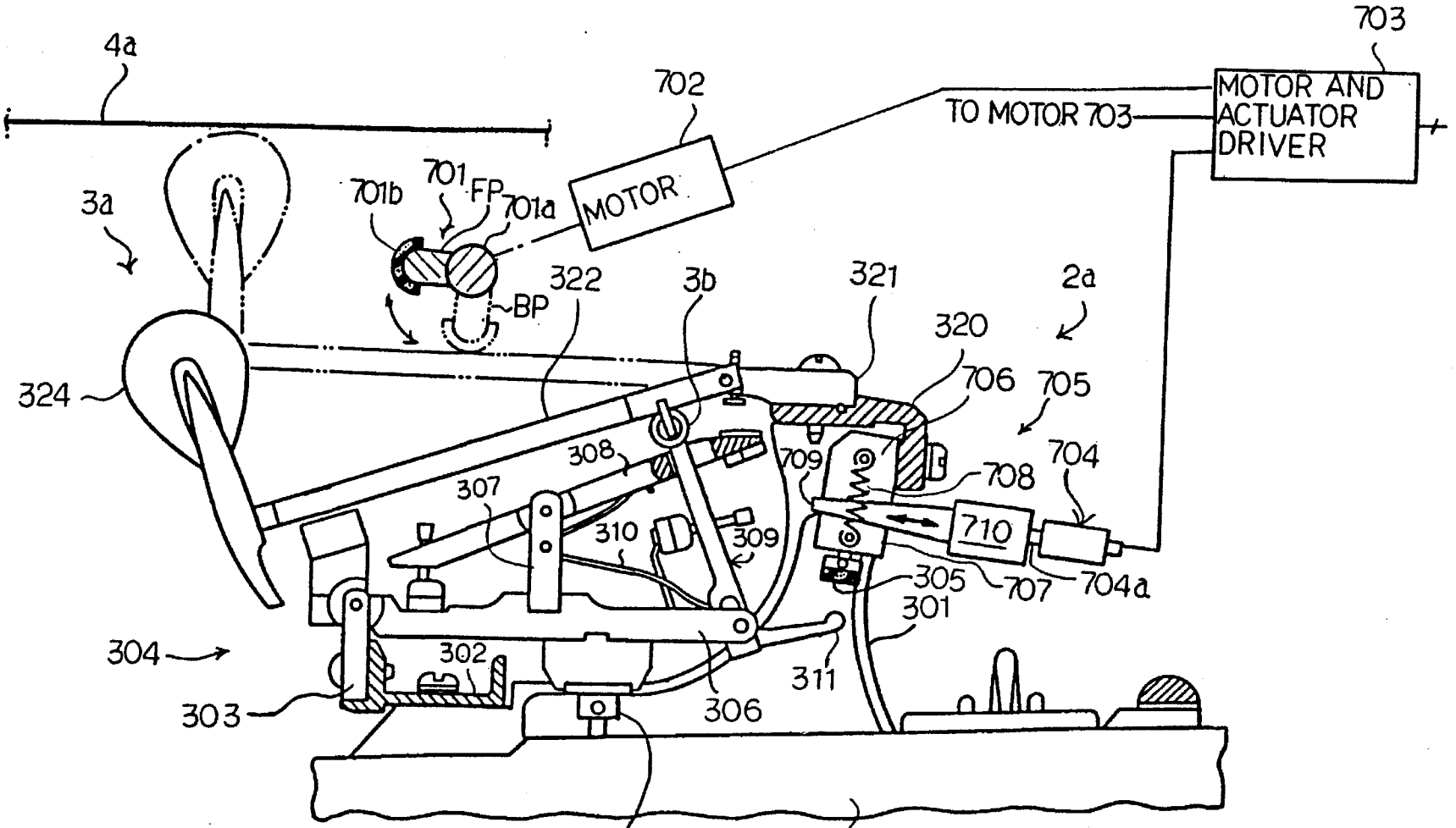
FIG. 2 is a partially cut-away side view showing the structure of a key action mechanism and a mode shifting system incorporated in the grand piano-like keyboard instrument shown in FIG. 1.

Turning to FIG. 2 of the drawings, one of the key action mechanisms 2 is linked with a capstan button 1*e* of the key 1*b*, and the associated hammer assembly 3*a* is provided for striking a set of strings 4*a* horizontally stretched over the key action mechanism 2.

The key action mechanism 2*a* largely comprises an action bracket 301 fixed to a bracket block mounted on the key bed 1*d*, a whippen rail 302 expending over the keys 1*a* and 1*b* and bolted to the action bracket 301, a whippen flange 303 fixed to the whippen rail 302, a whippen assembly 304 turnable around the whippen flange 303 and a regulating button 305 supported by the action bracket 301 and associated with the whippen assembly 304. Although a back check is further incorporated in the key action mechanism 2*a*, FIG. 2 does not illustrate it.

The whippen assembly 304 comprises a whippen 306 swingably supported by the whippen flange 303, a repetition lever flange 307 upright from the whippen 306, a repetition lever 308 rockably supported by the repetition lever flange 307, a jack 309 swingably supported by the leading end of the whippen 306 and a repetition spring 310 urging the repetition lever 308 in the counter clockwise direction, and the jack 309 is held in contact with a hammer roller 3*b* of the associated hammer assembly 3*a* while the key 1*b* is in the rest position. The jack 309 has a toe 311 opposed to the regulating button 305, and the gap between the toe 311 and the regulating button 305 is adjusted to a predetermined value.

If the key 1*b* is depressed, the whippen 306 rotates in the counter clockwise direction, and the jack 309 pushes up the hammer roller 3*b* and, accordingly, the hammer assembly 304. When the toe 311 comes into contact with the regulating button 305, the jack 309 per se turns around the whippen 306 in the clockwise direction against a repetition spring 310, and, finally, kicks the hammer assembly 3*a*. The hammer assembly 3*a* thus escaped from the jack 309 rushes toward the set of strings 4*a* at high speed, and rebounds on the strings 4*a*.

The hammer assembly 3*a* comprises a shank flange rail 320 bolted to the action bracket 301 and shared between the hammer assemblies 3, a shank flange 321 bolted to the shank flange rail 320, a hammer shank 322 turnable around the shank flange 321, the hammer roller 3*c* rotatably supported by the hammer shank 322, and a hammer head 324 fixed to the leading end of the hammer shank 322.

Before the toe 311 comes into contact with the regulating button 205, the hammer roller 3*c* is held in rolling contact with the jack 309. However, when the jack 309 kicks the hammer roller 3*c*, the hammer assembly 3*a* is escaped from the jack 309, and rushes toward the set of strings 4*a*.

Turning back to FIG. 1 of the drawings, each of the damper assemblies 5 comprises a damper lever rail 500 shared between the damper assemblies 5, a damper lever flange 501 fixed to the damper lever rail 500, a damper lever 502 turnably supported by the damper lever flange 501, a damper block 503 pivotally connected with the damper lever 502, a damper wire 504 projecting from the damper block 503 through a damper guide rail, a damper head 506 connected with the leading end of the damper wire 504.

While the key 1*b* is staying in the rest position, the damper lever 502 is pushed down due to the self-weight, and the damper head 506 is held in contact with the associated set of strings 4*a* for damping the strings. The leading end portion of the damper lever 502 is spaced from the rear end portion of the key 1*b*.

When the key 1*b* is depressed, the key 1*b* is moving from the rest position to the end position, and the rear end of the key 1*b* comes into contact with the damper lever 502. The key 1*b* pushes up the damper lever 502, and the damper lever 502 turns around the damper lever flange 501 in the counter clockwise direction. The damper wire 504 and the damper head 506 are lifted by the damper lever 502, and the damper head 506 is left from the set of strings 4*a*. As a result, the strings 4*a* are allowed to vibrate upon a strike with the hammer assembly 3*a*.

Although a damper pedal of the pedal mechanism 6 can keep the damper head 506 off, no further description is incorporated hereinbelow, because relation between the damper pedal sub-mechanism and a damper assembly is known to a person skilled in the art.

Figure 3:
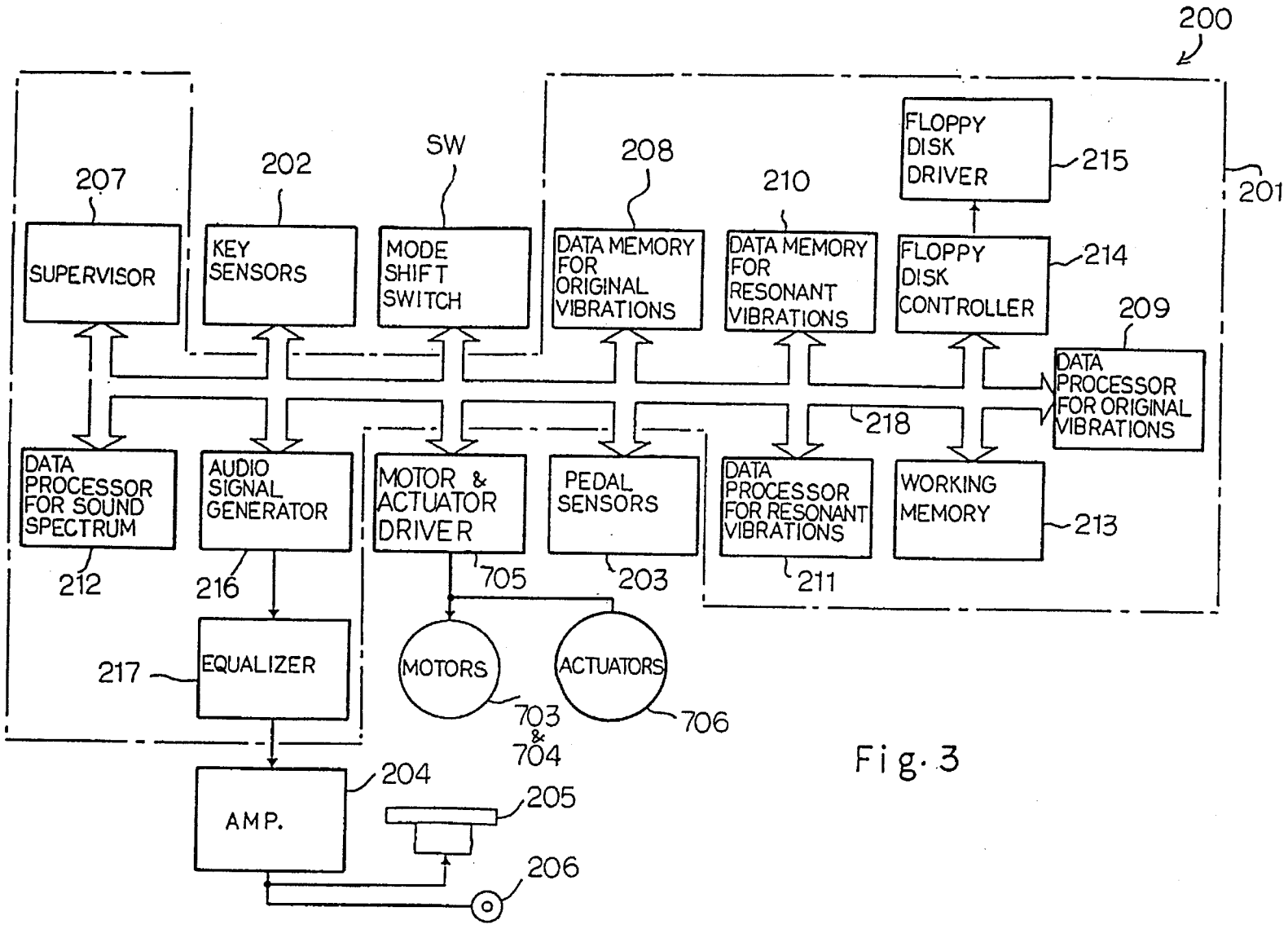
FIG. 3 is a block diagram showing the arrangement of an electronic sound generating system incorporated in the grand piano-like keyboard instrument shown in FIG. 1.

Turning to FIG. 3 of the drawings, the electronic sound generating system 200 comprises a sound processing unit 201, a plurality of key sensors 202, a plurality of pedal sensors 203, an amplifier unit 204, a speaker system 205 and a headphone 206, and is activated in the electronic sound producing sub-mode.

The plurality of key sensors 202 is respectively associated with the plurality of keys 1*a* and 1*b*, and each of the key sensors 202 comprises a shutter plate 202*a* fixed to the bottom surface of the associated key and a photo-interrupter 202*b* monitoring the shutter plate 202*a*. Four different patterns are formed in the shutter plate 202*a*, and the four patterns sequentially passes through an optical path produced by the photo interrupter 202*b* when the associated key is depressed. Time intervals between the four patterns are reported from the photo interrupter 202*a* to the sound processing unit 201, and the sound processing unit 201 determines the key velocity and estimates the time when the associated hammer strikes the strings 4*a*.

The pedal sensors 203 monitor the three pedals of the pedal mechanism 6 to see whether or not the player steps on any one of the three pedals. If the player steps on one of the pedals, the pedal sensors 203 detect the motion of the pedal, and report the position of the manipulated pedal to the sound processing unit 201.

The sound processing unit 201 comprises a supervisor 207, a data memory 208 for original vibrations, a data processor 209 for original vibrations, a data memory 210 for resonant vibrations, a data processor 211 for resonant vibrations, a data processor 212 for sound spectrum, a working memory 213, a floppy disk controller 214, a floppy disk driver 215, an audio signal generator 216, an equalizer 217 and a bus system 218.

As will be described hereinlater in detail, a mode shift switch SW produces a mode signal MODE indicative of one of the acoustic sound mode, the electronically sound producing sub-mode and the true silent sub-mode, and the mode signal MODE is assigned to one of the signal input ports. The other signal input ports are assigned the key sensors 202 and the pedal sensors 203.

The supervisor 207 sequentially scans signal input ports assigned to the mode control signal MODE, the detecting signals from the key sensors 202 and the detecting signals from the pedal sensors 203, and supervises the other components 208 to 214 and 216 for producing an audio signal.

An internal table is incorporated in the supervisor 207, and the internal table defines relation between the key numbers, key velocity and timings for producing the audio signal. The audio signal is supplied from the equalizer 217 to the amplifier unit 204, and the audio signal is selectively distributed to the speaker system 205 and the headphone 206 for producing synthesized sounds. Various internal registers are incorporated in the supervisor 207, and one of the internal registers is assigned to a mode flag indicative of the presently designated mode.

The data memory 208 for original vibrations stores a plurality sets of pcm (Pulse Code Modulation) data codes indicative of frequency specular of original vibrations on the strings 4, and each set of pcm data codes is corresponding to one of the keys 1*a* and 1*b*. A plurality groups of pcm data codes form a set of pcm data codes, and are corresponding to frequency specular at different intensities or hammer speeds. In general, if a hammer head 324 strongly strikes the associated string 4*a*, higher harmonics are emphasized.

The plurality sets of pcm data codes are produced with a sampler (not shown) through sampling of actual vibrations on the sets of strings 4 at appropriate sampling frequency. However, the set of pcm data codes may be produced by means of the data processor 212 through a real-time manner. Using a group of pcm data codes, original vibrations produced upon depressing a key 1*a* or 1*b* are restored, and the supervisor 207 controls the sequential access to a group of pcm data codes stored in the data memory 208.

The data processor 209 for original vibrations is provided in association with the data memory 208, and modifies a group of pcm data codes for an intermediate hammer speed. The modification with the data processor 209 is also controlled by the supervisor 207.

As described hereinbefore, the intensity of frequency spectrum is corresponding to the hammer speed. However, the intensities are variable with the type and model of the piano.

The data memory 210 for resonant vibrations stores a plurality sets of pcm data codes indicative of resonant vibrations, and the resonant vibrations take place under step on the damper pedal. While a player steps on a damper pedal of a piano, the damper heads 506 are held off, and some of the strings are resonant with the strings 4*a* directly struck by the associated hammer head 324. The resonant tones range −10 dB and −20 dB with respect to the tone originally produced through strike with the hammer head 324, and time delay of several millisecond to hundreds millisecond is introduced between the originally produced tone and the resonant tones.

If the player continuously steps on the damper pedal, the resonant tones continues several seconds. However, the player can rapidly terminate the original and resonant tones by releasing the damper pedal, and the audio signal generator 216 is responsive to the detecting signal of the pedal sensors 203 for the rapid termination.

The pcm data codes stored in the data memory 210 are indicative of frequency specular of the resonant vibrations, and are also produced by means of the sampler or the data processor 211 for resonant vibrations.

Each of the plurality sets of pcm data codes for the resonant tones is addressable with one of the depressed keys 1*a* or 1*b*, and is constituted by six groups of pcm data codes at the maximum. Each group of pcm data codes is corresponding to one of the resonant strings 4*a*, and the second harmonic to the sixth harmonic are taken into account for strings one octave higher than low-pitched sounds. However, if the depressed key is lower than the thirteenth key from the lowest key of the eighty-eight keys, the string one octave lower than the depressed key should be taken into account.

A set of pcm data codes are sequentially read out from the data memory 210 depending upon the depressed key 1*a* or 1*b* under the control of the supervisor 207, and the data processor 211 for resonant vibrations modifies the pcm data codes for an intermediate intensity. The memory capacity of the data memory 210 may be large enough to store the pcm data codes at all of the detectable hammer speeds, and the data processor 211 may calculate each set of pcm data codes on the basis of parameters stored in the data memory 210.

The data processor 212 for sound spectrum can produce not only a group of pcm data codes indicative of frequency spectrum for original vibrations but also a set of pcm data codes indicative of frequency specular for resonant vibrations as described hereinbefore. The data processor 212 is further operative to cause the frequency specular to decay. In detail, when a player releases a key 1*a* of an acoustic piano, original vibrations on a set of strings rapidly decays, because an associated damper head is brought into contact with the strings. The data processor 207 simulates the decay of the vibrations in the acoustic piano, and sequentially decreases the values of the pcm data codes. The resonant tones continue for several seconds in so far as the player keeps the damper pedal in the depressed state. However, if the player releases the damper pedal, the resonant tones are rapidly decayed. The data processor 212 also simulates the decay, and sequentially decreases the values of the pcm data codes for the resonant vibrations.

The decay is not constant. If the player releases the damper pedal through a half pedal, the tones decay at lower speed rather than the ordinary release. Moreover, some players use the half pedal in such a manner as to retard low-pitched tones rather than high-pitched tones, and such a pedal manipulation is called as an oblique contact. On the contrary, if the damper pedal causes all the dampers to be simultaneously brought into contact with the strings, the damper manipulation is referred to as simultaneous contact. The data processor 212 can simulate the gentle decay for the release through the half pedal as well as the oblique contact, and the values of the pcm data codes are decreased at either high, standard or low speed in the simultaneous contact and at different speed in the oblique contact. The data processor 212 may change the ratio between the fundamental tone and the harmonics thereof for the half pedal, and decay high-order harmonics faster than the fundamental tone. The frame of an acoustic piano usually vibrates, and the frame noises participate the piano tone. The data processor 212 may take these secondary noises into account and modify the frequency ratio.

The audio signal generator 216 comprises a digital filter, a digital-to-analog converter and a low-pass filter, and produces an analog audio signal from the pcm data codes supplied from the data memories 208 and 210 and/ or the data processors 209, 211 and 212. The pcm data codes are subjected to a digital filtering, and are, then, converted into the analog audio signal. In the digital filtering, the vibration characteristics of the speaker system 205 and vibratory characteristics of the speaker box (not shown) are taken into account, and the pcm data codes are modified in such a manner that the frequency spectrum of produced sounds becomes flat. The digital filter is of the FIR type. However, an IIR type digital filter is available. An oversampling type digital filter may follow the digital filtering for eliminating quantized noises.

After the digital filtering, the digital-to-analog converter produces the analog audio signal, and the analog audio signal is filtered by the low-pass filter. The low-pass filter is of a Butterworth type for improving group delay. The analog audio signal thus filtered is supplied through the equalizer 217 to the amplifier unit 204, and the amplifier unit 204 amplifies the analog audio signal for driving the speaker system 205 or the headphone 206.

The floppy disk driver 215 reads out data codes formatted in accordance with the MIDI standards from a floppy disk under the control of the floppy disk controller 214, and the supervisor 207 allows the audio signal generator 216 to reproduce sounds from the data codes read out from the floppy disk. Therefore, a music can be reproduced in the timbre of another musical instrument such as, for example, a pipeorgan, a harpsichord or a wind musical instrument.

The supervisor 207 may format the detecting signals of the key sensors 202 and the detecting signals of the pedal sensors 203 in accordance with the MIDI standards, and the MIDI codes are stored in a floppy disk under the control of the floppy disk controller 214. If the keyboard instrument can record and reproduce a performance, the keyboard instrument has four modes of operation, i.e., the acoustic sound mode, the silent mode, the recording mode and the playback mode, and the silent mode also has two sub-modes.

Turning back to FIG. 2 of the drawings, the mode controlling system 700 comprises a bracket member 700*a* bolted to the frame 12*a* connected with a pin block 12*b*, a shank stopper 701 turnably supported by post members outside the frame 12*a*, a electric motor unit 702 for changing the shank stopper 701 between a free position FP and a blocking position BP through a bidirectional rotation and a motor and actuator driver 703. The motor and actuator driver 703 energizes the electric motor unit 702 and solenoid-operated actuator units 704 under the control of the supervisor 207. The solenoid-operated actuators 704 are described in detail hereinlater.

The bracket member 700 is located over the hammer assemblies 3*a*, and the shank stopper 701 comprises a rotational bracket 701*a* coupled with the motor unit 704 and a cushion member 701*b* bonded to the rotational bracket 701*a*.

While the grand piano-like keyboard instrument is in the acoustic sound mode, the motor and actuator driver 703 keeps the shank stopper 701 in the free position FP as indicated by a real line, and allows the hammer heads 324 to strike the associated sets of strings 4.

On the other hand, when the grand piano is in the silent mode, the shank stopper 701 enters into the blocking position BP indicted by dots-and-dash line, and the hammer shanks 322 comes into contact with the shank stopper 701 on the way toward the associated sets of strings 4. Large force is exerted to the shank stopper 701 at the impact. However, the frame 12*a* is so rigid that the impact can not have any influence on the grand piano-like keyboard instrument.

The mode controlling system 7 further comprises a gap regulating sub-mechanism 705 so as change the gap between the jacks 309 and the regulating buttons 305 depending upon the mode of operation.

Figure 4:
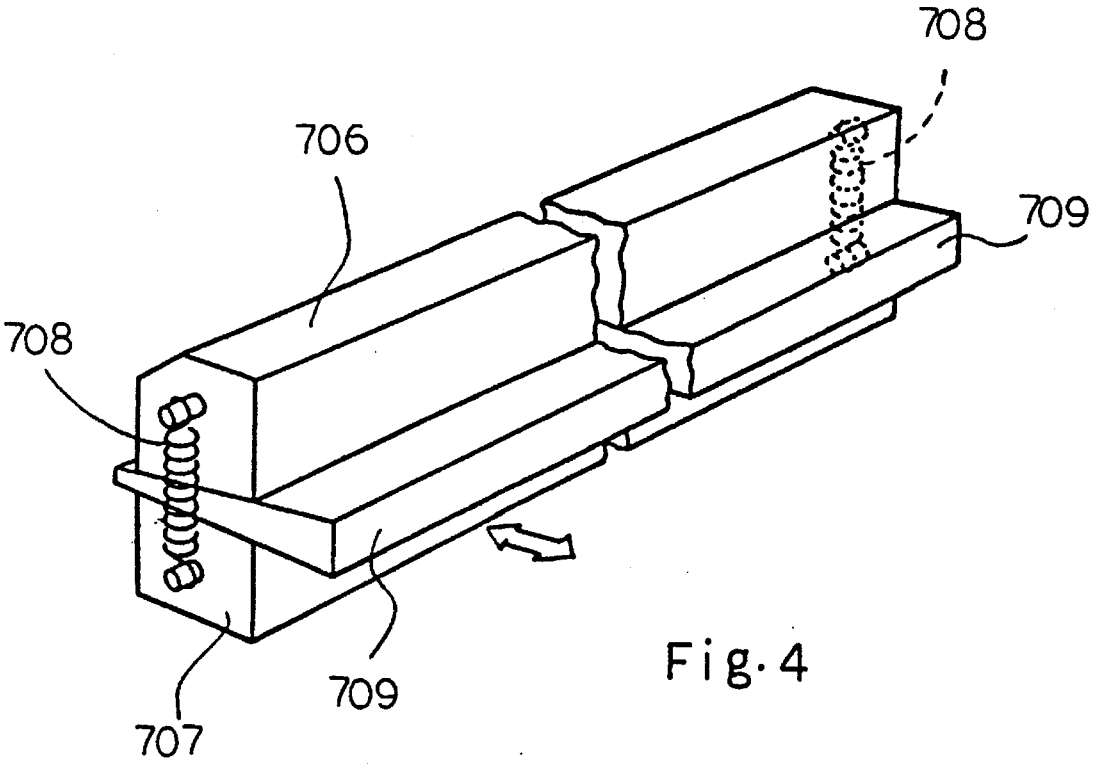
FIG. 4 is a perspective view showing a gap regulating sub-system incorporated in the grand piano-like keyboard instrument shown in FIG. 1.

In detail, the gap regulating sub-mechanism 705 comprises an upper rail member 706 bolted to the shank flange rail 320, a lower rail member 707 pressed toward the upper rail member 706 by means of springs 708, three wedge members 709 inserted between the upper rail member 706 and the lower rail member 707, a beam member 710 supporting the three wedge members 709 and the solenoid operated actuator unit 704 for moving the beam member 710 and, accordingly, the three wedge members 709 between a projecting position and a retracted position under the control of the motor and actuator driver unit 703. FIG. 4 illustrates the wedge members 709 sandwiched between the upper rail member 706 and the lower rail member 707.

The three wedge members 709 are respectively associated with the key action mechanisms 2*a* for high-pitch tones, the key action mechanisms 2*a* for middle pitch tones and the key action mechanisms 2*a* for low-pitch tones, and the oblique surfaces of the three wedge members 709 are respectively adjusted to appropriate angles. The solenoid-operated actuators 704 have respective plungers 704*a* attached to both end portions of the beam member 710, and uniformly advance the wedge members 709 between the upper rail member 706 and the lower rail member 707 against the elastic force of the springs 708.

While the grand piano-like keyboard instrument is in the acoustic sound mode, the solenoid-operated actuators 704 retract the plungers 704*a*, and the wedge members 709 enters into the retracted position. The springs 708 cause the lower rail member 707 to be closer to the upper rail member 706, and the regulating buttons 305 are spaced from the toes 311 of the associated jacks 309. In this situation, the gaps between the toes 311 and the regulating buttons 305 are adjusted to standard values of a grand piano.

On the other hand, when the grand piano-like keyboard instrument enters into the silent mode, the solenoid-operated actuator units 704 projects the plungers 704*a*, and the wedge members 709 enters into the projecting position. The wedge members 709 push down the lower rail member 707 against the elastic force of the springs 708, and the regulating buttons 305 becomes closer to the toes 311 of the associated jacks 309. The gaps between the toes 311 and the regulating buttons 305 are decreased to predetermined values, and allow the jacks 309 to escape from the associated hammer assemblies 3*a* before contact with the shank stopper 701 in the blocking position BP.

In this instance, the wedge members 709 changes the gaps between the regulating buttons 305 and the toes 311 by about 1 millimeter, and the gap between the hammer heads and the sets of strings at the escape is between 5 to 7 millimeters. However, while the wedge members 709 is retracted, the gap between the hammer heads and the sets of strings are about 2 millimeters, and is equal to the standard value of a grand piano.

Figure 5A:
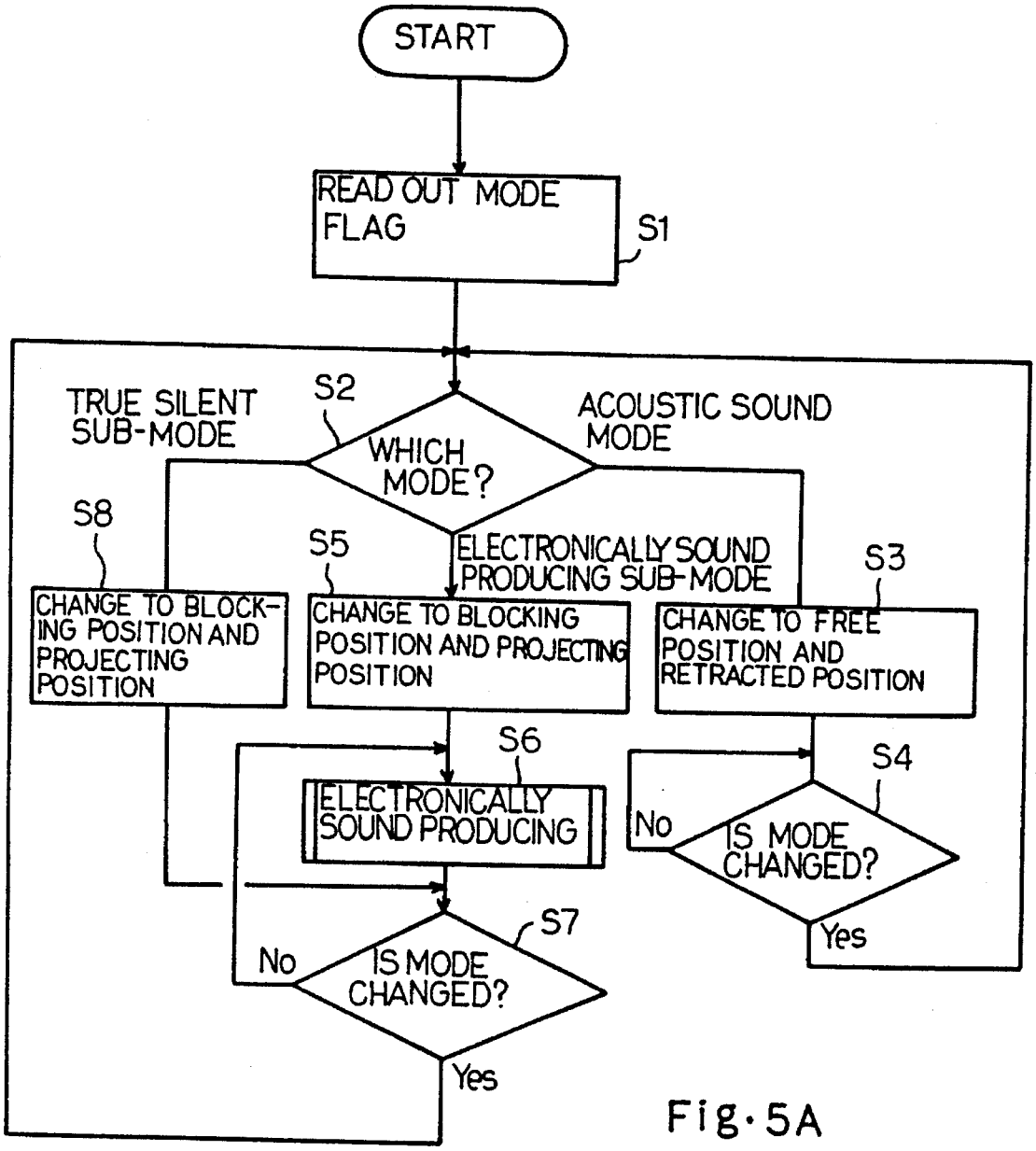
FIGS. 5A and 5B are flowcharts showing program sequences executed by a sound processing unit incorporated in the electronic sound generating system.

Description is made on performances in both acoustic sound and silent modes with reference to FIG. 5A. When the sound producing unit 201 is powered, the supervisor 207 reads out the mode flag from the internal register as by step S1, and checks the mode flag to see whether the player instructs the acoustic sound mode, the electronically sound producing sub-mode or the true silent sub-mode as by step S2.

If the player designates the grand piano-like keyboard instrument to enter into the acoustic sound mode, the supervisor 207 instructs the motor and actuator driver unit 705 to change the shank stopper 701 and the wedge members 709 to the free position FP and the retracted position, respectively, as by step S3.

Then, the electric motor unit 702 rotates the rotational member 701*a* in the clockwise direction, and the shank stopper 701 becomes close to the lower surface of the bracket member 700*a*. The solenoid-operated actuator 704 retracts the wedge members 709, and the springs 708 lifts the lower rail member 707 and the wedge members 709. As a result, each hammer head 324 can strike the associated set of strings 4*a* without interruption of the shank stopper 701, and the gaps between the regulating buttons 305 and the toes of the associated jacks 309 are regulated to the standard values.

While the player is performing a music on the keyboard 1, the key 1*b* is assumed to be depressed. The key 1*b* is moved from the rest position toward the end position, and the capstan button 1*e* pushes up the whippen heel, and the key action mechanism 2*a* behaves as similar to the silent mode.

The key 1*b* lifts the damper lever 502, and the damper lever 502 leaves the damper head 506 from the strings 4*a*. The key action mechanism 2*a* drives the hammer assembly 3*a*, and the hammer shank 302 is escaped from the jack 210 at the standard timing. The hammer assembly 3*a* rotates in the clockwise direction, and the hammer head 324 strikes the strings 4*a* without any interruption of the shank stopper 701. The strings vibrate, and produce an acoustic sound. The player feels the key-touch usual, because the jack 309 escapes at the standard timing as similar to a grand piano.

While the player is performing a music in the acoustic sound producing mode, the supervisor 207 periodically checks the input port assigned to the mode signal MODE to see whether or not the player changes the mode from the acoustic sound producing mode to the electrically sound producing sub-mode or the true silent sub-mode as by step S4. If the answer to the step S4 is given negative, the supervisor 207 repeats step S4, and the player continues to perform the music.

However, if the player manipulates the mode shift switch SW, the answer to the step S4 is given positive, and the supervisor 207 returns to step S2. If the answer to the step S2 is indicative of the electronically sound producing sub-mode, the supervisor 207 rewrites the mode flag, and instructs the motor and actuator driver unit 705 to change the shank stopper 701 and the wedge members 709 to the blocking position BP and the projecting position as by step S5. Then, the cushion member 701*b* is directed to the hammer shanks 322, and the gaps between the regulating buttons 305 and the toes 311 cause the jacks 309 to escape earlier than the acoustic sound mode.

While the player is selectively depressing the block and white keys 1*a* and 1*b*, the sound processing unit 201 electronically synthesizes sounds through an electronically sound producing sub-routine S6 in cooperation with the key sensors 202, the pedal sensors 203, the amplifier 204 and the headphone 206. Of course, the player can hear the synthesized sounds from the speaker system 205. However, if the player hears the sounds with the headphone 206, the synthesized sounds do not disturb people sleeping in bed.

In the electronically sound producing sub-mode, the key action mechanisms 2*a* also drive the hammer mechanisms 3*a*, and the regulating buttons 305 restricts the toes 311 earlier than the acoustic sound mode. For this reason, the jacks 309 escape from the hammer assemblies 3*a* before contact with the shank stopper 701. As a result, the key action mechanisms 2*a* and the hammer mechanisms 3*a* give the piano key-touch to the player. However, the hammer shanks 322 impacts on the cushion member 701*b*, and any noises are not mixed with the synthesized sounds.

While the player is performing a music in the electronically sound producing sub-mode, the supervisor 207 periodically checks the mode flag to see whether or not the player changes the operation mode as by step S7. If the answer is given negative the sound producing unit 201 continues to produce the synthesized sounds in accordance with the depressed keys 1*a* ad 1*b* and the pedals.

Figure 5B:
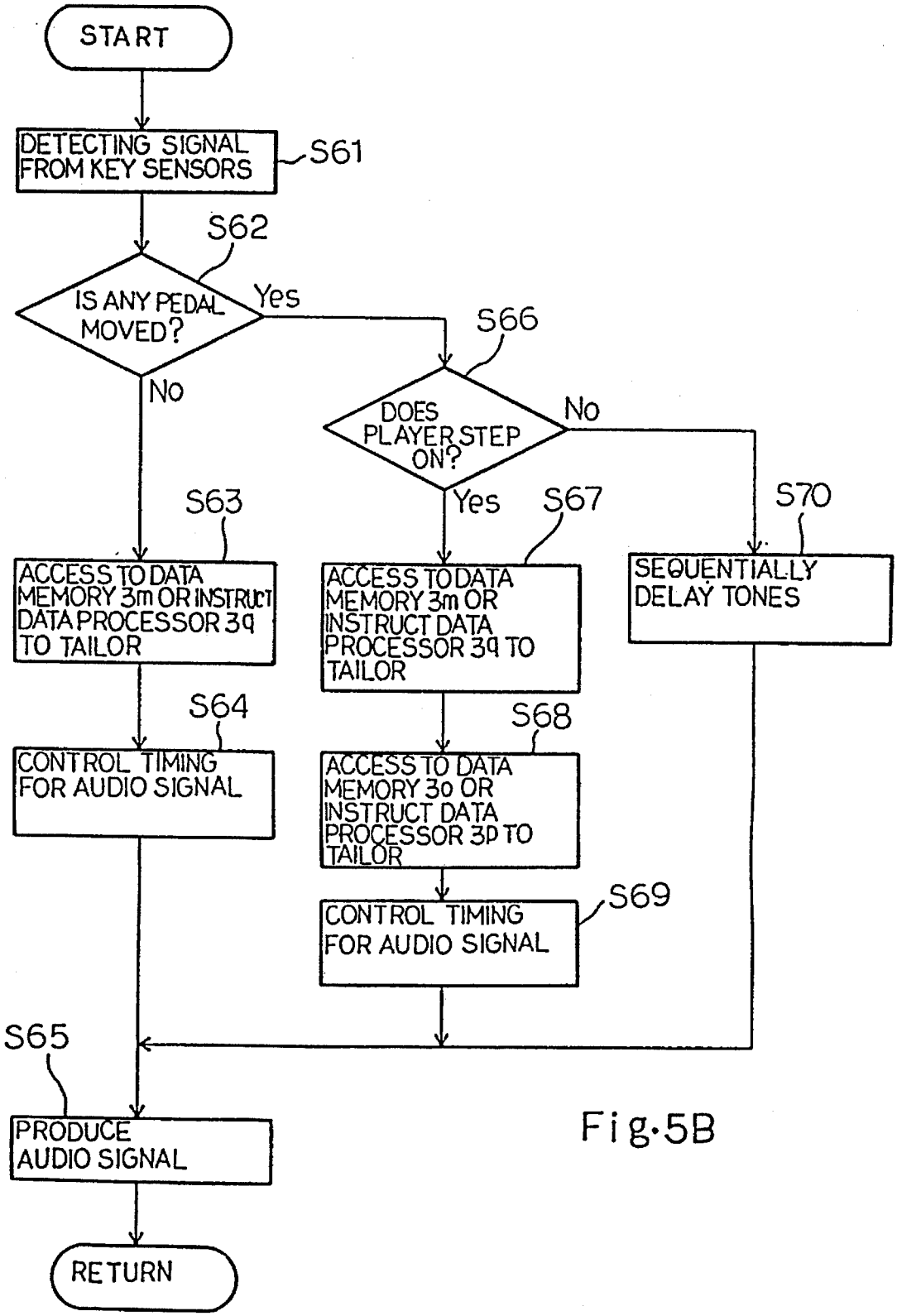

FIG. 5B illustrates the electronically sound producing sub-routine. Upon entry of the electronically sound producing sub-routine S6, the supervisor 207 monitors the input port assigned to the detecting signals from the key sensors 202, and receives the detecting signal from the key sensors 202 as by step S61, if any. After the receipt of the detecting signal, the supervisor 207 identifies the depressed key, and determines the key velocity on the basis of the detecting signal.

The supervisor 207 further checks the input port assigned to the detecting signals from the pedal sensors 203 to see whether or not the player steps on one of the pedals as by step S62. If the answer to the step S62 is given negative, the supervisor 207 accesses one of the groups of pcm data codes associated with the depressed key in the data memory 208 or instructs the data processor 212 to tailor a group of pcm data codes for the depressed key.

The supervisor 207 accesses the internal table thereof, and determines appropriate timing for producing the audio signal as by step S64. The supervisor 207 waits for the appropriate timing, and supplies the group of pcm data codes to the audio signal generator 216 for producing the audio signal as by step S65. The audio signal is amplified by the amplifier 204, and the headphone 206 produces a synthesized sound corresponding to the depressed key.

After the step S65, the supervisor 207 returns to the program sequence shown in FIG. 5A, and proceeds to step S7.

However, if one of the pedal such as the damper pedal is moved, the answer to the step S62 is given positive, and the supervisor 207 checks the detecting signal from the pedal sensors 203 to see whether or not the pedal is pushed down as by step S66. If the player steps on the pedal, the answer to the step S66 is given positive, and the supervisor 207 accesses the pcm data codes in the data memory 208 or instruct the data processor 212 to tailor the pcm data codes as by step S67.

The supervisor 207 further accesses the pcm data codes in the data memory 210 or instructs the data processor 211 to tailor the pcm data codes as by step S68 so as to simulate the resonant vibrations on the related strings. The supervisor 207 controls the timing of the pcm data codes for the original vibrations and the timing of the pcm data codes for the resonant vibrations as by step S69, and time delay is introduced between the timing for the original vibrations and the timing for the resonant vibrations. Upon completion of the step S69, the supervisor 3*k* proceeds to the step S65.

On the other hand, if the pedal is upwardly moved to the rest position, the answer to the step S66 is given negative, and the supervisor 207 instructs the data processor 212 to sequentially decrease the values of the pcm data codes at a selected speed so as to decay the synthesized tone and the resonant tones as by step S70. Then, the supervisor 3I proceeds to the step S65.

Turning back to FIG. 5A, while the player is performing the music in the electronically sound producing sub-mode, the supervisor 207 periodically checks the input port assigned to the mode shift signal MODE to see whether or not the mode is changed to the acoustic sound producing mode or the true silent sub-mode as described hereinbefore. If the answer to the step S7 is given positive, the supervisor 3*k* returns to the step S2 again.

If the player requests the grand piano-like keyboard instrument to enter into the true silent sub-mode, the supervisor 207 instructs the motor and actuator driver 705 to keep the shank stopper 322 and the wedge members 709 in the blocking position BP and the projecting position as by step S8, and proceeds to step S7. Therefore, the player can practices the fingering on the keyboard 1 without any sound.

Thus, the supervisor 3*k* sequentially executes the loop consisting of the steps S2 to S8, and the player performs the music in one of the acoustic sound mode, the electronically sound producing sub-mode and the true silent sub-mode.

As will be appreciated from the foregoing description, the mode controlling system 700 incorporated in the grand piano-like keyboard instrument gives the identical key touch with a grand piano to the player in the acoustic sound mode, and allows the sound producing unit 201 to produce the synthesized tones with a quasi-key-touch.

Figure 6:
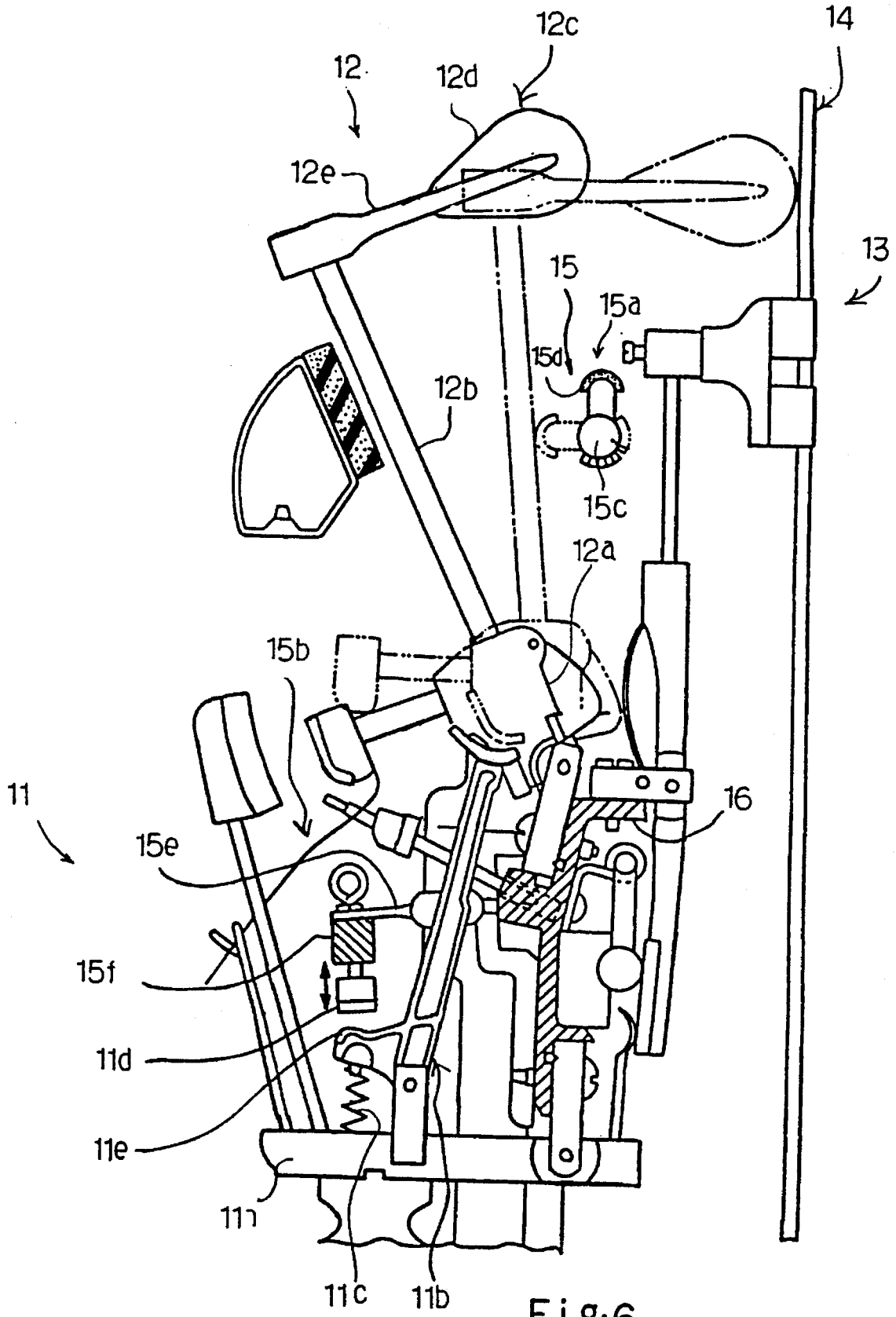
FIG. 6 is partially cut way side view showing essential parts of upright piano-like keyboard instrument according to the present invention.

The gap regulating sub-system is applicable to an upright piano-like keyboard instrument. FIG. 6 shows essential parts of the upright piano-like keyboard instrument, and the upright piano-like keyboard instrument selectively enters an acoustic sound mode and a silent mode.

While staying in the acoustic sound mode, the upright piano-like keyboard instrument serves as an acoustic upright piano, and not only the sounds but also the key-touch are identical with those of the acoustic upright piano.

On the other hand, the upright piano-like keyboard instrument electrically synthesizes sounds in response to keying-in in an electronically sound producing sub-mode of the silent mode, and the acoustic sounds are not produced.

The upright piano-like keyboard instrument comprises a keyboard, a plurality of key action mechanisms 11, a plurality of hammer mechanisms 12, a plurality of damper mechanisms 13, plurality sets of strings 14 and a pedal mechanism. However, only one key action mechanism 11, the associated hammer mechanism 12, the associated damper mechanism 13 and the associated set of strings 14 are illustrated in FIG. 6.

Each of the key action mechanisms 11 comprises an whippen 11*a* held in contact with a capstan button upright from the rear end of the associated key, a jack 11*b* rotatably provided on the whippen 11*a* a jack spring 11*c* urging the jack 11*b* in the counter clockwise direction and a regulating button 11*d* opposed to a toe 11*e* of the jack 11*b*, and the jack 11*b* drives the associated hammer mechanism 12 for rotation.

Each of the hammer mechanisms 12 comprises a butt 12*a* kicked by the jack 11*b*, a hammer shank 12*b* implanted in the butt 12*a* and a hammer head 12*c* connected with the leading end of the hammer shank 12*b*. The hammer shank 12*b* is formed of maple or the like, and the hammer head 12*c* is implemented by a hammer felt 12*d* attached to a hammer wood 12*e*.

The mode controlling system 15 comprises a shank stopper mechanism 15*a* and a gap regulating sub-system 15*b*, and the shank stopper mechanism 15*a* and the gap regulating sub-system 15*b* are changed between a free position and a blocking position and between a retracted position and a projecting position depending upon the operation mode.

Though not shown in the drawings, a driving mechanism is associated with a rod member 15*c*, and rotates the rod member 15*c* so as to change cushion members 15*d* attached thereto between the free position indicated by the real line and the blocking position indicated between a dots-and-dash line.

While the upright piano-like keyboard instrument is in the acoustic sound mode, the driving mechanism causes the cushion members 15*d* to enter into the free position, and the hammer head 12*d* can strike the associated set of strings 14 without interruption of the shank stopper mechanism 15*a*.

On the other hand, if the upright piano-like keyboard instrument enters into the silent mode, the driving mechanism rotates the rod member 15*c*, and the hammer shank 12*b* is brought into contact with the cushion members 15*d* before strike at the associated strings 14.

The gap regulating sub-system 15*b* comprises a deformable regulating bracket 15*e* fixed to a center rail 16, a regulating rail 15*f* attached to the lower surface of the deformable regulating bracket 15*e* and a driving mechanism 15*g* (see FIG. 7), and the driving mechanism 15*g* resiliently deforms all of the regulating brackets including the bracket 15*e*. The regulating rail 15*f* is split into three rail portions respectively associated with the regulating buttons 11*d* for high-pitch tones, the regulating buttons 11*d* for middle-pitch tones and the regulating buttons 11*d* for the low-pitched tones.

Figure 7:
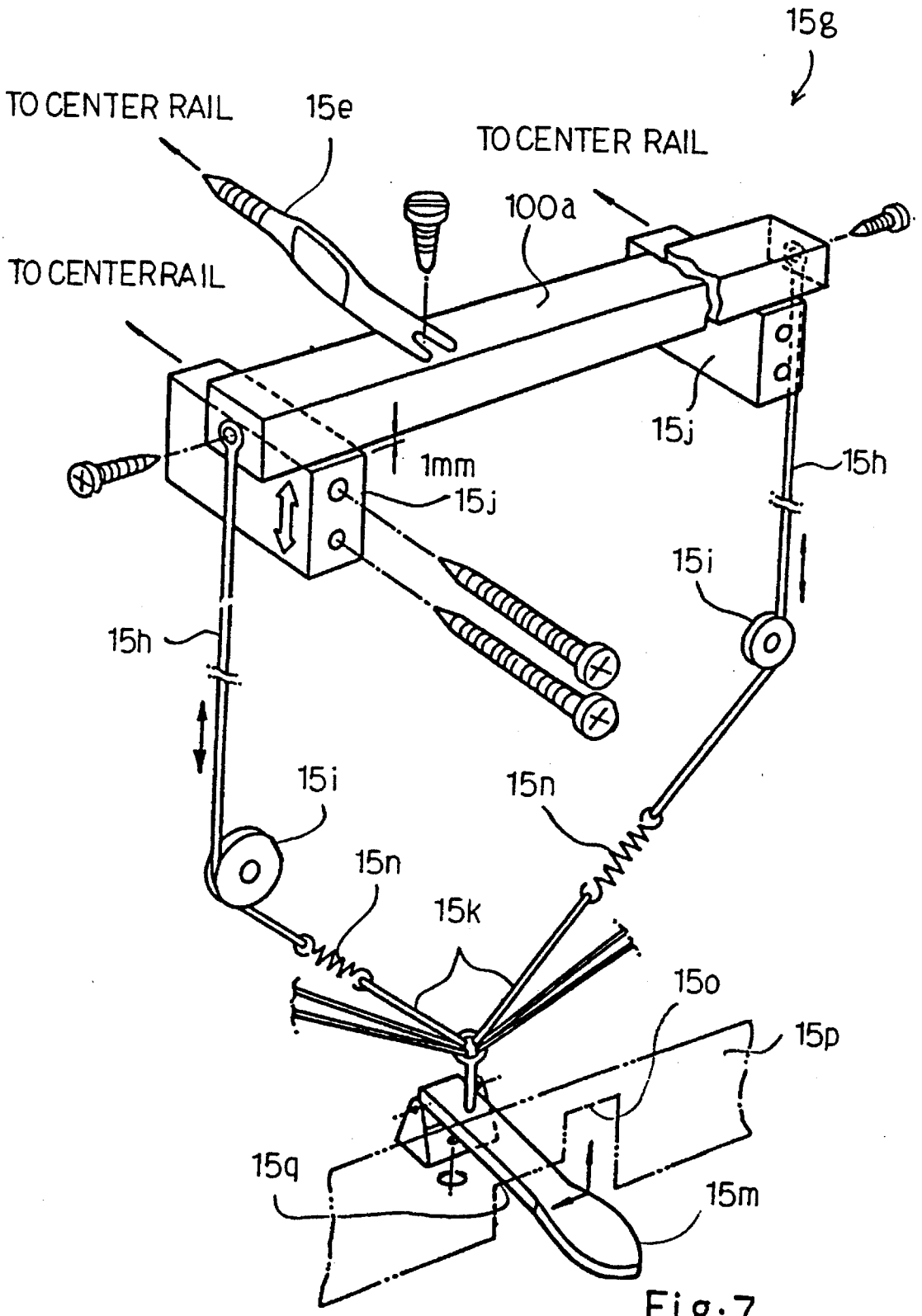
FIG. 7 is a perspective view showing a gap regulating mechanism incorporated in the upright piano-like keyboard instrument.

Turning to FIG. 7 of the drawings, a part of the driving mechanism 15*g* associated with only one of the rail portions 100*a* is illustrated, and the other parts are similar to that associated with the rail portion 100*a*. The driving mechanism 15*g* comprises a pair of wires 15*h* bolted to both ends of the rail portion 100*a*, a pair of timing rollers 15*i* rotatably supported by a case of the upright piano for providing tension to the wires 15*h*, a pair of stoppers 15*j* bolted to the center rail 16 for restricting a downward motion of the rail portion 100*a*, a pair of wires 15*k* anchored to a pedal 15*m*, and a pair of springs 15*n* inserted between the pair of wires 15*h* and the pair of wires 15*k*.

While any force is exerted on the pedal 15*m*, the springs 15*n* pull up the pedal 15*m*, and the pedal 15*m* is held in contact with the uppermost edge of a lower board 15*p*. When a player steps on the pedal 15*m*, the pedal 15*m* pulls down the wires 15*k*, and the rail portion 100*a* is moved downwardly by 1 millimeter. As a result, the regulating brackets 15*e* is deformed by 1 millimeter, and gaps between the repetition buttons 11*d* and the toes 11*e* of the associated jacks 11*b* are decreased to 5–7 millimeters which is narrower than the standard values by 1 millimeter.

If the player laterally moves the pedal 15*m*, the pedal 15*m* is engaged with a lower edge 15*q* of the lower board 15*p* as shown in FIG. 7.

Thus, the gaps are regulable depending upon the mode of operation. In the silent mode, the regulating buttons 11*d* closer to the toes 11*e* allows the jacks 11*b* to escape from the hammer buts 12*a* before contact with the cushion members 15*d*, and an electronic sound producing unit produces synthesized tones instead of the acoustic tones.

On the other hand, while being in the acoustic sound mode, the regulating buttons 11*d* return to the home positions, and allow the jacks 11*b* to escape from the butts 12*a* at regular timings, respectively, and the key-touch is ordinary.

Figure 8:
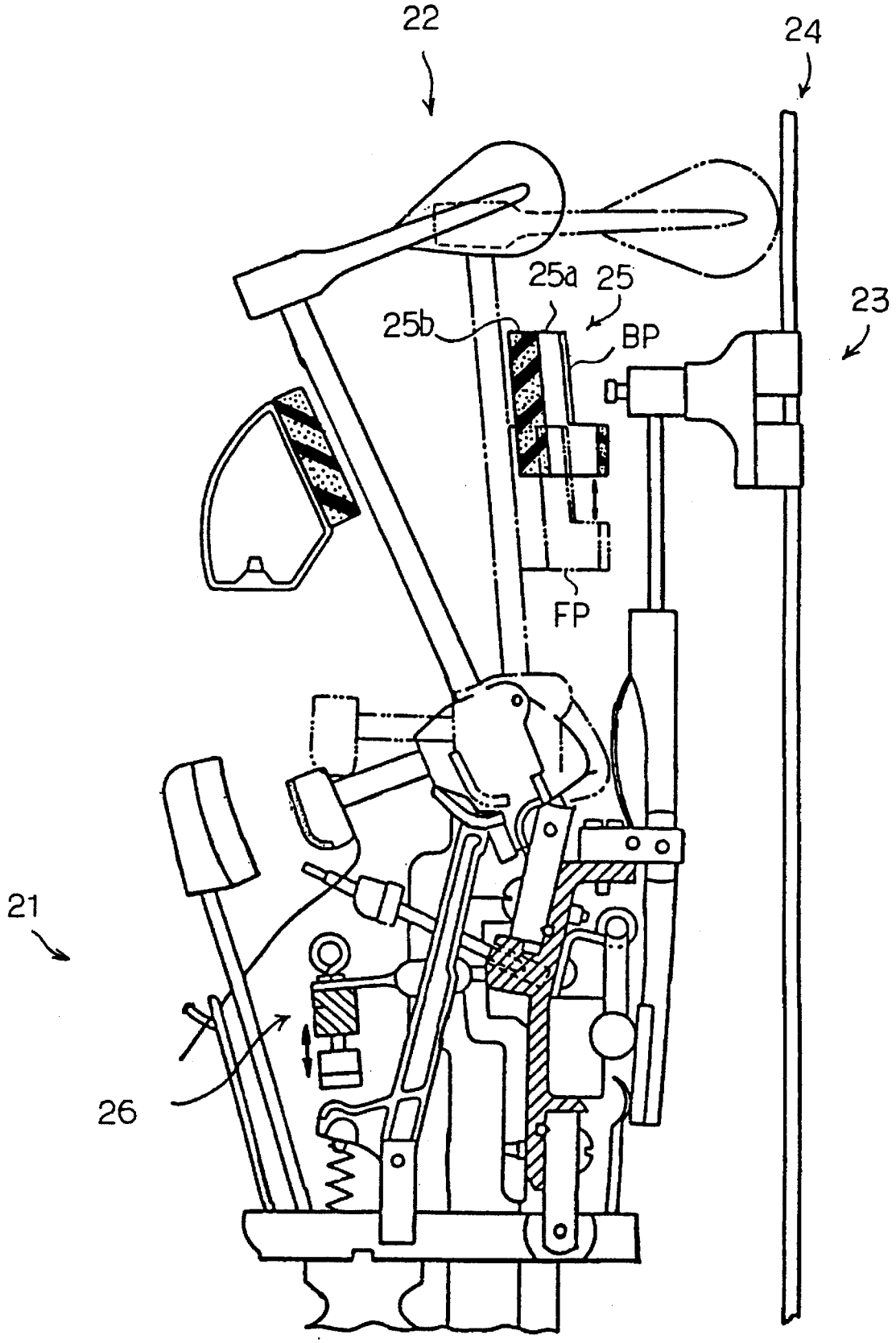
FIG. 8 is a partially cut-away side view showing essential parts of another upright piano-like keyboard instrument according to the present invention.

Turning to FIG. 8 of the drawings, a key action mechanism 21, a hammer mechanism 22, a damper mechanism 23, a set of strings 24, a shank stopper and a gap regulating sub-mechanism 26 are incorporated in an upright piano-like keyboard instrument. The key action mechanism 21, the hammer mechanism 22, the damper mechanism 23, the set of strings 24 and the gap regulating sub-mechanism 26 are similar to those of the upright piano-like keyboard instrument shown in FIG. 6, and no further description is incorporated hereinbelow for the sake of simplicity.

The shank stopper 25 comprises a supporting member 25*a* and cushion members 25*b* attached to the supporting member 25*a*, and the shank stopper 25 is movable between a free position FP in the acoustic sound mode and a blocking position BP in the silent mode.

The gap regulating sub-system 26 changes the gaps between the regulating buttons and the toes of the jacks as similar to the gap regulating sub-system shown in FIG. 6.

Second Embodiment

Figure 9:
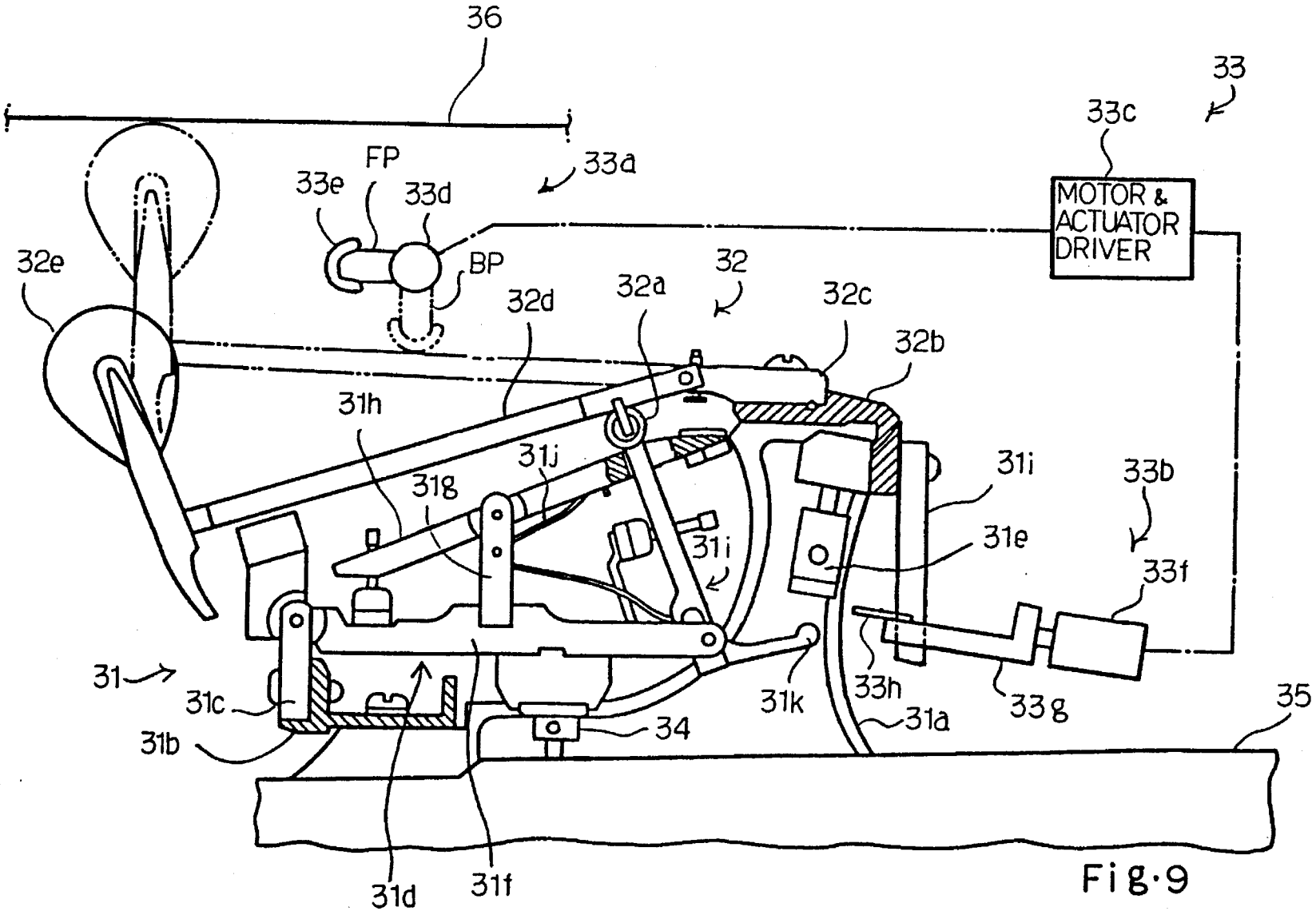
FIG. 9 is a partially cut-away side view showing essential parts of another grand piano-like keyboard instrument according to the present invention.

Turning to FIG. 9 of the drawings, a key action mechanism 31 and a hammer mechanism 32 is incorporated in another grand piano-like keyboard instrument together with a mode controlling system 33. Of course, the key action mechanism 31 and the hammer mechanism 32 are associated with one of the keys of a keyboard, and the other keys are also accompanied with the key action mechanisms 31 and the hammer mechanisms 32. The other components are similar to those of the first embodiment, and are not illustrated in FIG. 9 for the sake of simplicity.

Each of the key action mechanisms 31 is linked with a capstan button 34 of a key 35, and the associated hammer assembly 32 is provided for striking a set of strings 36 horizontally stretched over the key action mechanism 31.

The key action mechanism 31 largely comprises an action bracket 31*a* fixed to a bracket block (not shown) mounted on a key bed (not shown), a whippen rail 31*b* expending over the keys and bolted to the action bracket 31*a*, a whippen flange 31*c* fixed to the whippen rail 31*b*, a whippen assembly 31*d* turnable around the whippen flange 31*c* and a regulating button 31*e* supported by the action bracket 31*a* and associated with the whippen assembly 31*d*.

The whippen assembly 31*d* comprises a whippen 31*f* swingably supported by the whippen flange 31*c*, a repetition lever flange 31*g* upright from the whippen 31*f*, a repetition lever 31*h* rockably supported by the repetition lever flange 31*g*, a jack 31*i* swingably supported by the leading end of the whippen 31*f* and a repetition spring 31*j* urging the repetition lever 31*h* in the counter clockwise direction, and the jack 31*i* is held in contact with a hammer roller 32*a* of the associated hammer assembly 32 while the key 35 is in the rest position.

The jack 31*i* has a toe 31*k* opposed to the regulating button 31*e*, and the gap between the toe 31*k* and the regulating button 31*e* is adjusted to a predetermined value. If the key 35 is depressed, the whippen 31*f* rotates in the counter clockwise direction, and the jack 31*i* pushes up the hammer roller 32*a* and, accordingly, the hammer assembly 32. When the toe 31*k* comes into contact with the regulating button 31*e*, the jack 31*i* per se turns around the whippen 31*f* against the repetition spring 31*j*, and, finally, kicks the hammer assembly 32. The hammer assembly 32 thus escaped from the jack 31*i* rushes toward the set of strings 36 at high speed, and rebounds on the strings 36.

The hammer assembly 32 comprises a shank flange rail 32*b* bolted to the action bracket 31*a* and shared between the hammer assemblies, a shank flange 32*c* bolted to the shank flange rail 32*b*, a hammer shank 32*d* turnable around the shank flange 32*c*, the hammer roller 32*a* rotatably supported by the hammer shank 32*d*, and a hammer head 32*e* fixed to the leading end of the hammer shank 32*d*.

Before the toe 31*k* comes into contact with the regulating button 31*e*, the hammer roller 32*a* is held in rolling contact with the jack 31*i*. However, when the jack 31*i* kicks the hammer roller 32*a*, the hammer assembly 32 is escaped from the jack 31*i*, and rushes toward the set of strings 36.

The mode controlling system 33 largely comprises a shank stopper 33*a*, a gap regulator 33*b* and a motor and actuator driver unit 33*c*, and the motor and actuator driver unit 33*c* behaves under the control of a supervisor of a sound producing unit (not shown) as similar to the motor and actuator driver unit 703.

The shank stopper 33*a* comprises an electric motor (not shown), a rotatable rod member 33*d* and cushion members attached to the rotatable rod member 33*d*. The electric motor (not shown) changes the cushion member between a free position FP in the acoustic sound mode and a blocking position BP in the silent mode.

Figure 10:
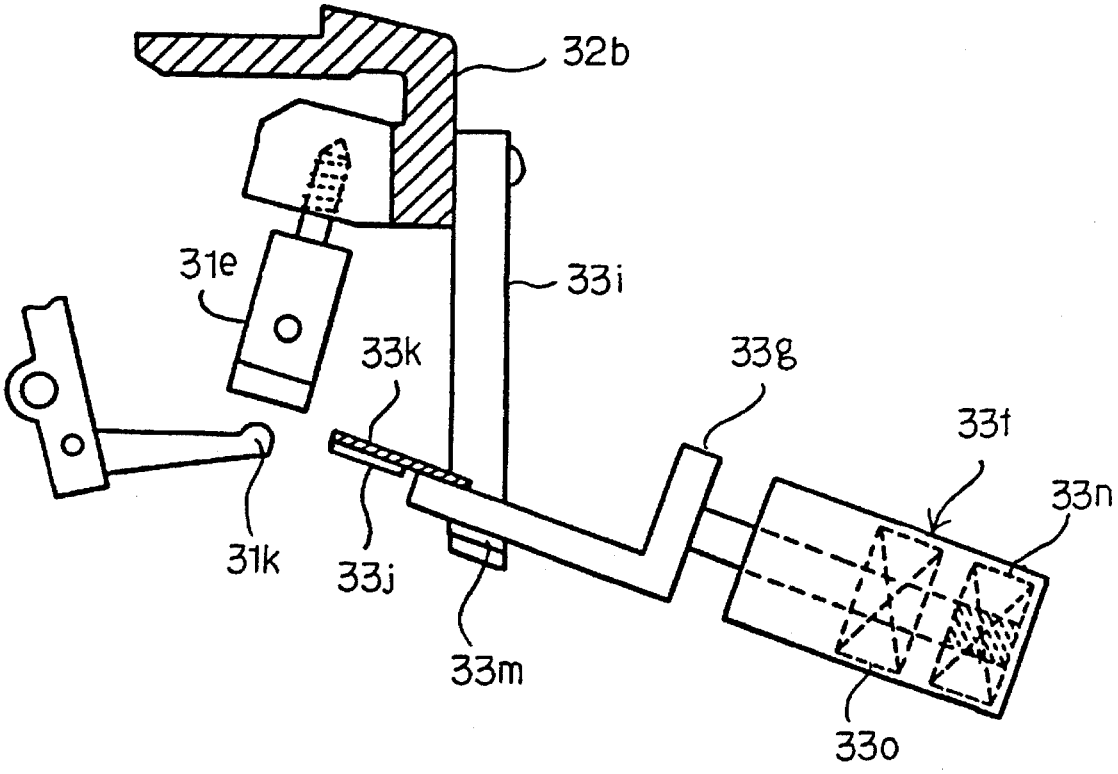
FIG. 10 is a side view showing, an enlarged scale, a gap regulator in a retracted position incorporated in the grand piano-like keyboard instrument shown in FIG. 9.
Figure 11:
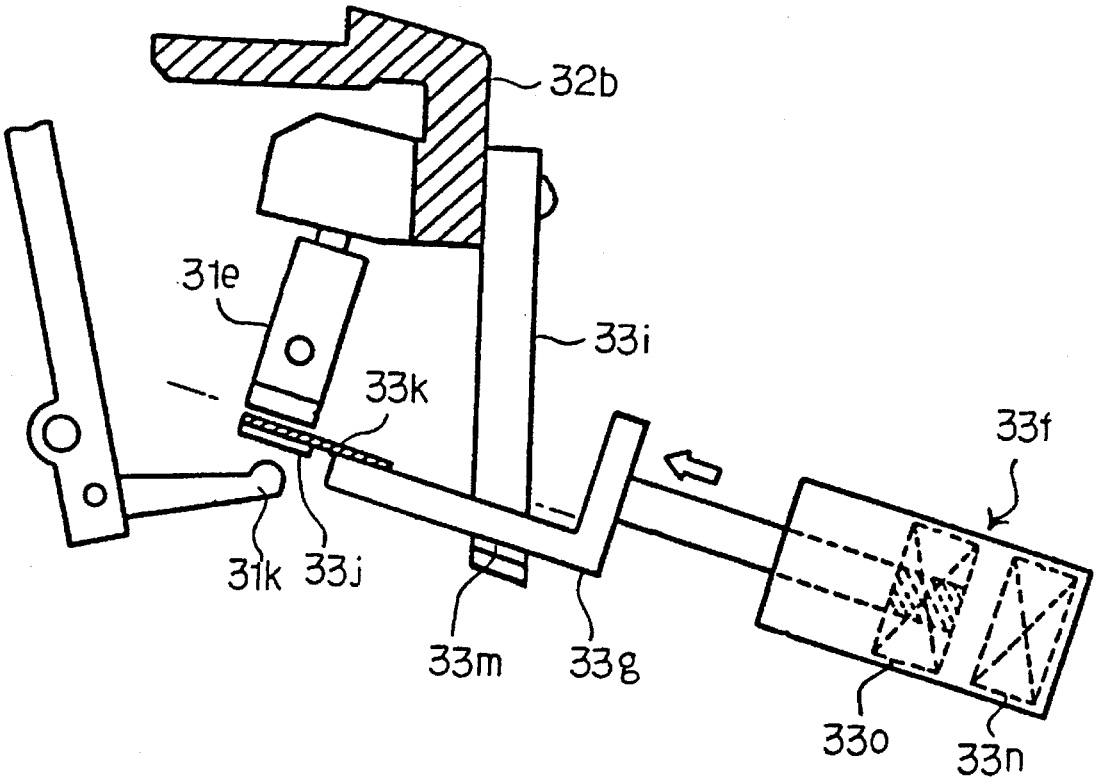
FIG. 11 is a side view showing the gap regulator in a projecting position.
Figure 12:
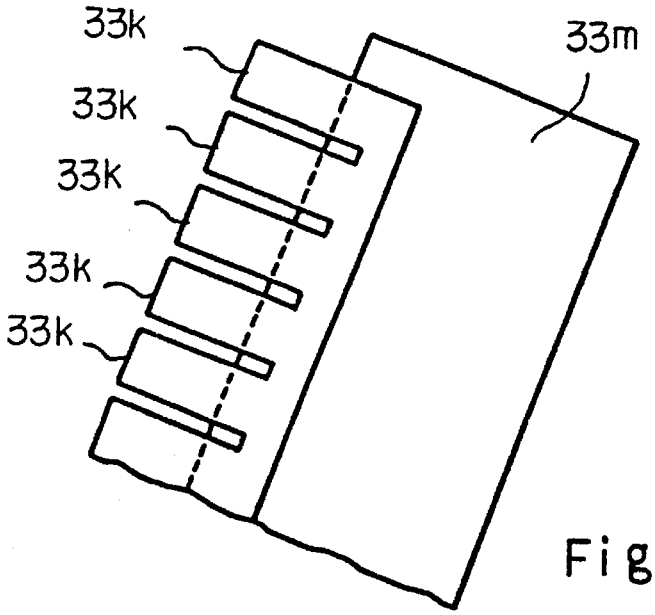
FIG. 12 is a plan view showing spacer plates integral with one another and incorproated in the grand piano-like keyboard instrument shown in FIG. 9.

The gap regulator 33*b* comprises a solenoid-operated actuator unit 33*f*, a bracket member 33*g*, a plurality of deformable spacer plates 33*h* respectively associated with the regulating buttons 31*e*, a guide member 33*i* bolted to the shank flange rail 32*b* for slidably supporting the bracket member 33*g* and cushion sheets 33*j* attached to the lower surfaces of the spacer plates 33*h* (see FIGS. 10 and 11). A lubricant sheet 33*m* is attached to the guide member 33*i*, and allows the bracket member 33*g* to smoothly slide thereover. In this instance, the spacer plates 33*h* are integral with one another, and fixed to the bracket member 33*m* as shown in FIG. 12.

When the grand piano-like keyboard instrument enters into the acoustic sound mode, a first coil member 33*n* is energized by the motor and actuator driver unit 33*c*, and the solenoid-operated actuator unit 33*f* keeps the bracket member 33*g* and, accordingly, the spacer plates 33*h* in a retracted position as shown in FIG. 10.

If, on the other hand, the grand piano-like keyboard instrument enters into the silent mode, the motor and actuator driver unit 33*c* energizes a second coil member 33*o*, and the solenoid-operated actuator unit 33*f* projects the bracket members 33*g* and the spacer plates 33*h* as shown in FIG. 11. As a result, the spacer plates 33*h* is positioned between the toes 31*k* and the regulating buttons 31*e*, and decreases the gaps between the toes 31*k* and the regulating buttons 31*e* by about 1 millimeter.

Therefore, while a player is performing a music in the acoustic sound mode, the shank stopper 33*a* and the gap regulator 33*b* are kept in the free position FP and the retracted position, respectively, and the hammer mechanisms strike the associated sets of strings 36 in response to the fingering on the keyboard. The gaps between the toes 31*k* and the regulating buttons 31*e* are standard values of a grand piano, and the key action mechanisms 31 and the hammer mechanisms 32 give the unique key-touch to the player.

On the other hand, when the grand piano-like keyboard instrument enters into the silent mode, the shank stopper 33*a* is shafted to the blocking position, and the spacer plates 33*h* are advanced to the projecting position. While the player is performing a music in the silent mode, the toes 31*k* are brought into contact with the cushion sheets 33*j* earlier than the contact with the regulating buttons 31*e*, and the jacks 31*i* escape from he hammer assemblies 32 before the contact with the cushion members 33*e*. Therefore, the key action mechanisms 31 and the associated hammer mechanisms 32 give a quasi piano like key-touch to the player, and the hammer shanks 32*d* rebound on the cushion members 33*e* without strike at the associated sets of strings 36. Even if a gap takes place between the spacer plate 33*h* and the regulating button 31*e*, the toes deforms the spacer plate 33*h*, and the jack 31*i* escapes at the same timings as the other jacks.

If the player wants to hear synthesized sounds, the electronic sound producing unit (not shown) supplies the audio signal to a headphone or a speaker as similar to the first embodiment.

Third Embodiment

Figure 13:
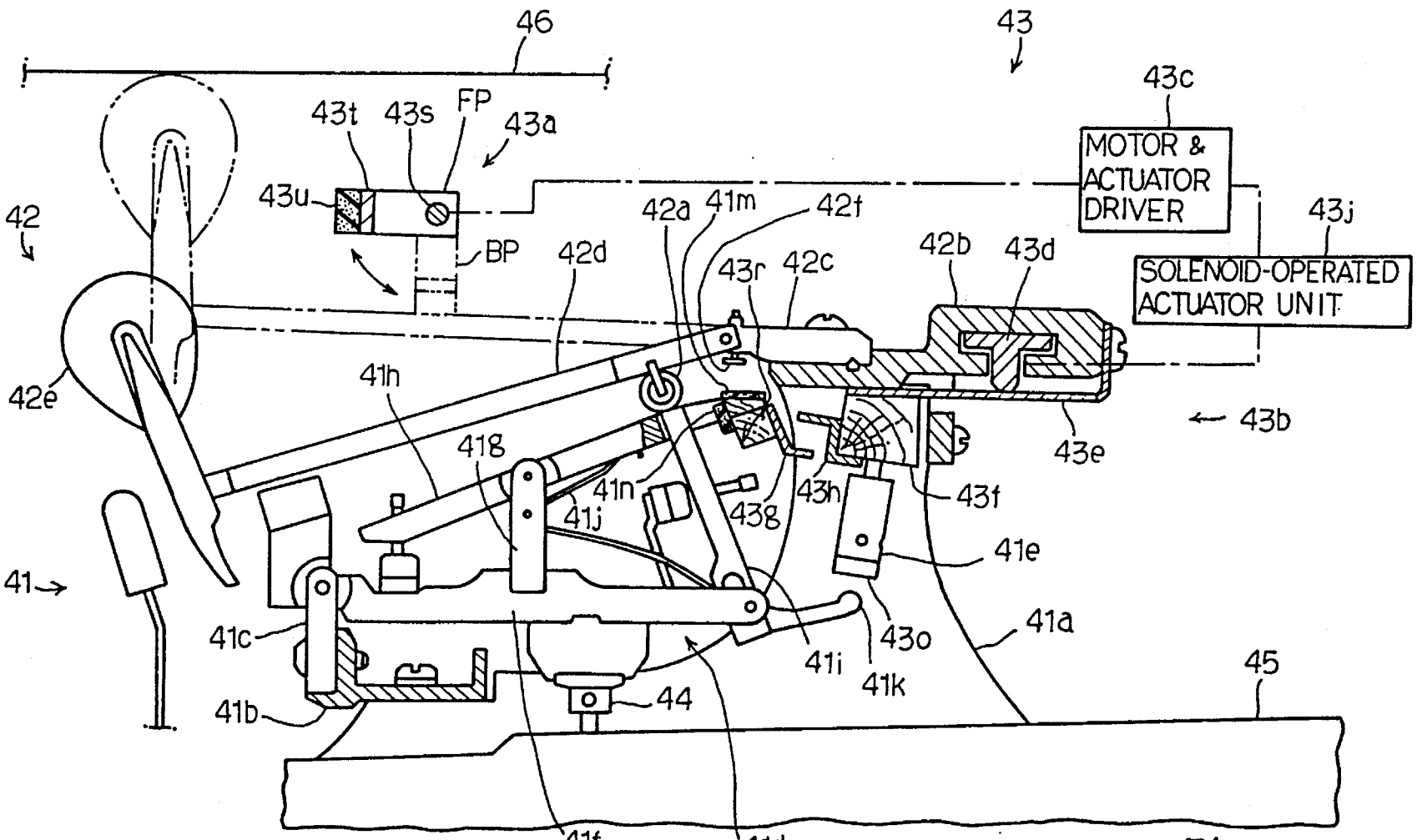
FIG. 13 is a partially cut-away side view showing essential parts of yet another grand piano-like keyboard instrument according to the present invention.

Turning to FIG. 13 of the drawings, a key action mechanism 41 and a hammer mechanism 42 is incorporated in yet another grand piano-like keyboard instrument together with a mode controlling system 43. Of course, the key action mechanism 41 and the hammer mechanism 42 are associated with one of the keys of a keyboard, and the other keys are also accompanied with the individual key action mechanisms 41 and the individual hammer mechanisms 42. The other components are similar to those of the first embodiment, and are not illustrated in FIG. 13 for the sake of simplicity.

Each of the key action mechanisms 41 is linked with a capstan button 44 of the key 45, and the associated hammer assembly 42 is provided for striking a set of strings 46 horizontally stretched over the key action mechanism 41.

The key action mechanism 41 largely comprises an action bracket 41*a* fixed to a bracket block (not shown) mounted on a key bed (not shown), a whippen rail 41*b* expending over the keys and bolted to the action bracket 41*a*, a whippen flange 41*c* fixed to the whippen rail 41*b*, a whippen assembly 41*d* turnable around the whippen flange 41*c* and a regulating button 41*e* supported by the action bracket 41*a* and associated with the whippen assembly 41*d*.

The whippen assembly 41*d* comprises a whippen 41*f* swingably supported by the whippen flange 41*c*, a repetition lever flange 41*g* upright from the whippen 41*f*, a repetition lever 41*h* rockably supported by the repetition lever flange 41*g*, a jack 41*i* swingably supported by the leading end of the whippen 41*f* and a repetition spring 41*j* urging the repetition lever 41*h* in the counter clockwise direction, and the jack 41*i* is held in contact with a hammer roller 42*a* of the associated hammer assembly 42 while the key 45 is in the rest position.

The jack 41*i* has a toe 41*k* opposed to the regulating button 41*e*, and the gap between the toe 41*k* and the regulating button 41*e* is adjusted to a predetermined value. If the key 45 is depressed, the whippen 41*f* rotates in the counter clockwise direction, and the jack 41*i* pushes up the hammer roller 42*a* and, accordingly, the hammer assembly 42. When the toe 41*k* comes into contact with the regulating button 41*e*, the jack 41*i* per se turns around the whippen 41*f* against the repetition spring 41*j*, and, finally, kicks the hammer assembly 42. The hammer assembly 42 thus escaped from the jack 41*i* rushes toward the set of strings 46 at high speed, and rebounds on the strings 46.

The hammer assembly 42 comprises a shank flange rail 42*b* bolted to the action bracket 41*a* and shared between the hammer assemblies, a shank flange 42*c* bolted to the shank flange rail 42*b*, a hammer shank 42*d* turnable around the shank flange 42*c*, the hammer roller 42*a* rotatably supported by the hammer shank 42*d*, and a hammer head 42*e* fixed to the leading end of the hammer shank 42*d*.

Before the toe 41*k* comes into contact with the regulating button 41*e*, the hammer roller 42*a* is held in rolling contact with the jack 41*i*. However, when the jack 41*i* kicks the hammer roller 42*a*, the hammer assembly 42 is escaped from the jack 41*i*, and rushes toward the set of strings 46.

The mode controlling system 43 largely comprises a shank stopper 43*a*, a gap regulator 43*b* and a motor and actuator driver unit 43*c*, and the motor and actuator driver unit 43*c* behaves under the control of a supervisor of a sound producing unit (not shown) as similar to the motor and actuator driver unit 703.

Figure 14:
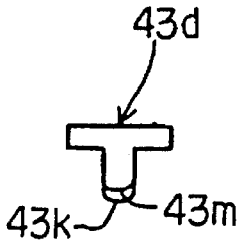
FIG. 14 is a side view showing a cam member incorproated in the grand piano-like keyboard instrument shown in FIG. 13.
Figure 15:
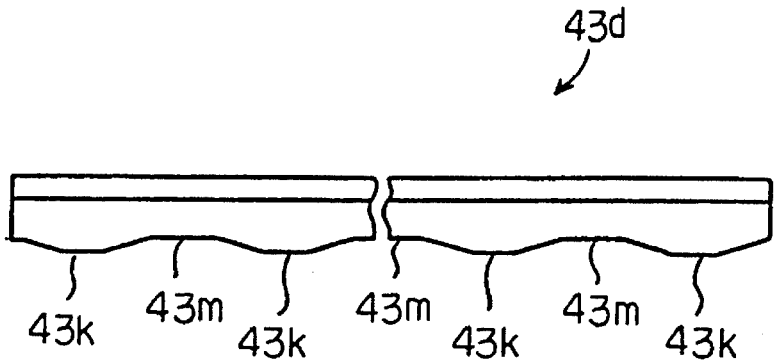
FIG. 15 is a front view showing the cam member incorporated in the grand piano-like keyboard instrument shown in FIG. 13.

The gap regulator 43*b* comprises a cam member 43*d* slidably accommodated in the shank flange rail 42*b*, leaf spring members 43*e*, a regulating rail member 43*f*, a pair of stoppers 43*g* and 43*h*, a cushion sheet 43*i*, and a solenoid-operated actuator unit 43*j*. As will be better seen from FIGS. 14 and 15, the cam member 43*d* has hill positions 43*k* and valley portions 43*m* alternating with one another, and the solenoid-operated actuator unit 43*j* moves the cam member 43*d* in the longitudinal direction thereof.

Figure 16:
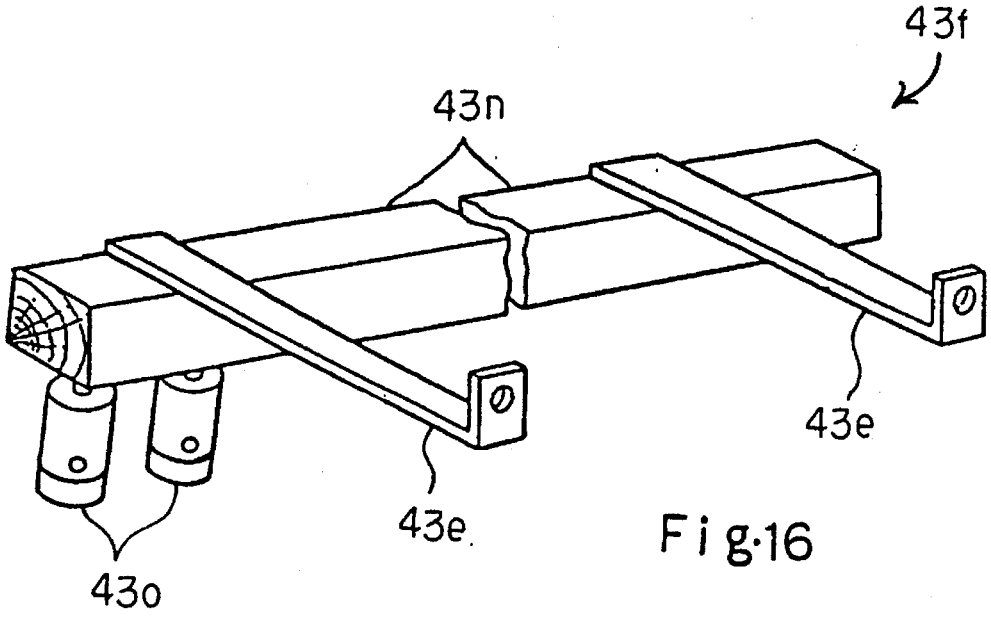
FIG. 16 is a perspective view showing a gap regulator incorporated in the grand piano-like keyboard instrument.

The leaf springs 43*e* are bolted to the shank flange rail 42*b*, and the hill portions 43*k* or the valley portions 43*m* are held in contact with the leaf springs 43*e*. The regulating rail member 43*f* is split into four to six blocks 43*n*, and each block 43*n* is supported by the two leaf springs 43*e* as shown in FIG. 16. The regulating buttons 41*e* are hung from the lower surfaces of the blocks 43*n*, and regulating button punching 43*o* are opposed to the associated toes 41*k*.

Figure 17:
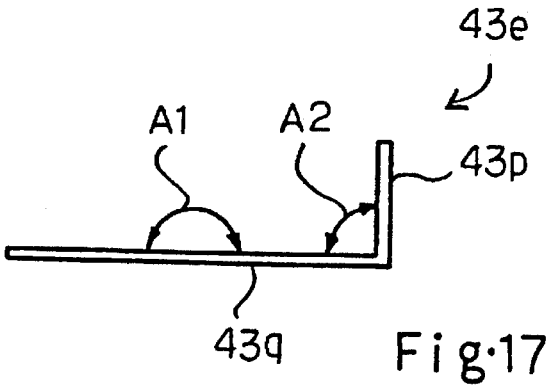
FIG. 17 is a side view showing a leaf spring member for supporting the gap regulator shown in FIG. 16.
Figure 18:
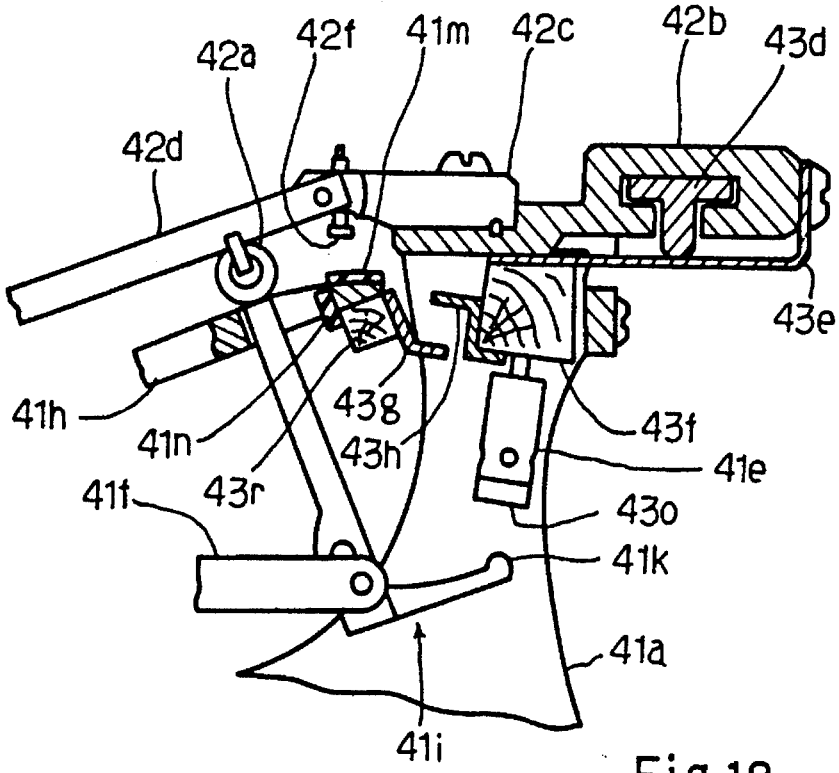
FIG. 18 is a partially cut-away side view showing the gap regulator in a retracted position.

The leaf springs 43*e* are shaped into a generally L-configuration, and each of the leaf springs 43*e* has a short portion 43*p* and a long portion 43*q* as shown in FIG. 17. The angle A1 between the short portion 43*p* and the long portion 43*q* is slightly smaller than the right angle, and the long portion 43*q* is bent at the intermediate point thereof at an angle A2 slightly smaller than 180 degrees. The angles A1 and A2 are changeable depending upon the relative positions between the regulating buttons 41*e* and the toes 41*k*.

While the leaf springs 43*e* are held in contact with the valley portions 43*m*, the elastic force of the leaf springs 43*e* lifts the regulating rail 43*f*, and the distance between the regulating button punching 43*o* and the toes 41*k* are equal to those of a grand piano.

However, if the solenoid-operated actuator unit 43*j* moves the cam member 43*d* so as to bring the hill portions 43*k* into contact with the leaf springs 43*e*, the cam member 43*d* urges the leaf springs 43*e* against the elastic force, and the regulating rail member 43*f* is pushed down by about 1 millimeter. As a result, the gaps between the regulating button punching 43*o* and the toes 41*k* are also decreased by about 1 millimeter.

Turning back to FIG. 13, the stoppers 43*g* and 43*h* are respectively attached to a wood piece 43*r* fixed to the repetition lever 41*h* and to the regulating rail member 43*f*. While the key 45 is in the rest position in the acoustic sound mode, the gap between the stoppers 43*g* and 43*h* is equal to or greater than the gap between a repetition regulating screw 42*f* and a repetition lever skin 41*m*, and the stoppers are brought into contact with one another concurrently to or after the contact between the repetition regulating screw 42*f* and the repetition lever skin 41*m* while the key 45 is traveling from the rest position to the end position. When the jack 41*i* escapes from the hammer assembly 42, the distance between the hammer head 42*e* and the strings 46 is about 2 millimeters, and the hammer assembly 42 returns to 2 millimeters lower than this point.

On the other hand, if the grand piano-like keyboard instrument enters into the silent mode, the cam member 43*d* pushes down the regulating rail member 43*f*, and the cam member 43*d* is shifted from a retracted position to a projecting position. The gap between the stoppers 43*g* and 43*h* becomes less than the gap between the repetition regulating screw 42*f* and the repetition lever skin 41*m*, and the stoppers 43*g* and 43*h* are brought into contact with each other before the repetition lever skin 41*m* comes into contact with the repetition regulating screw 42*f*.

The shank stopper 43*a* comprises a rod member 43*s* coupled with an electric motor unit (not shown), a supporting bracket member 43*t* connected with the rod member 43*s* and four to six cushion members 43*u* attached to the supporting bracket member 43*t*.

While the grand piano-like keyboard instrument is in the acoustic sound mode, the motor and actuator driver unit 43*c* causes the electric motor (not shown) to keep the cushion members 43*u* in a free position FP, and the hammer heads 42*e* strike the associated sets of strings 46 without interruption of the shank stopper 43*a*.

On the other hand, if the grand piano-like keyboard instrument enters into the silent mode, the electric motor (not shown) moves the cushion members 43*u* to the blocking position BP, and the hammer shanks 42*d* are brought into contact with the cushion members 43*u* before the hammer heads 42*e* strike the associated sets of strings 46.

Figure 19:
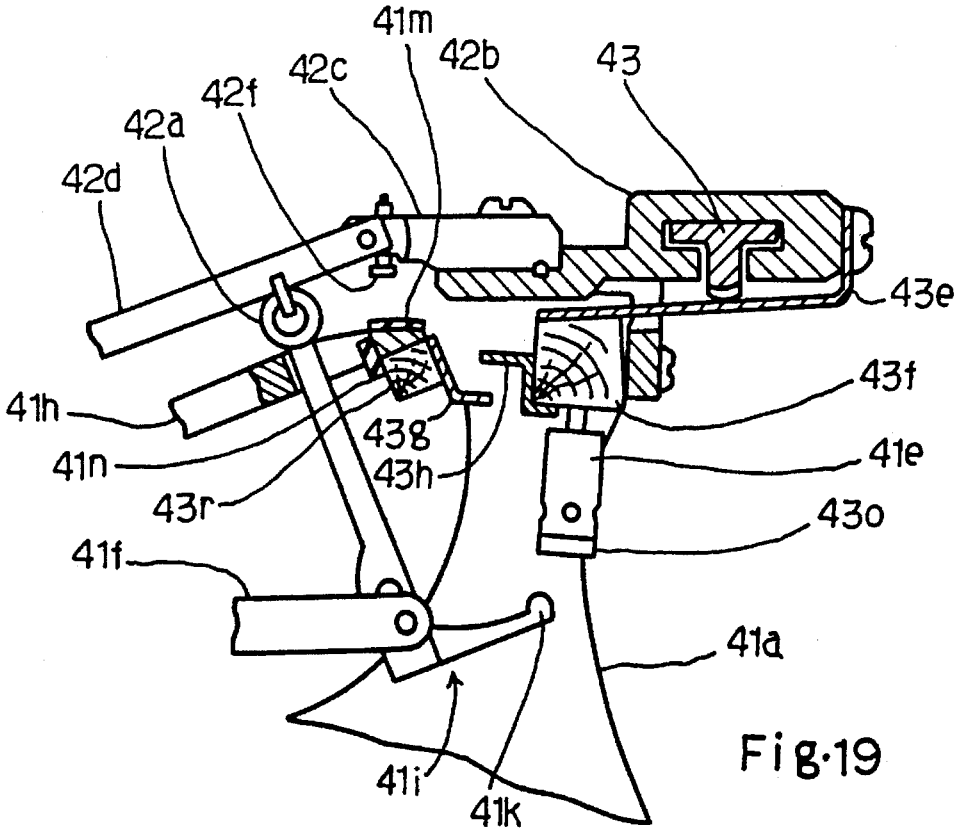
FIG. 19 is a partially cut-away view showing the gap regulator in a projecting position.

Description is made on the silent mode with reference to FIG. 19. When the grand piano-like keyboard instrument enters into the silent mode, the sound producing unit (not shown) instructs the motor and actuator driver unit 43*c* to change the shank stopper 43*a* and the gap regulator 43*b* to the blocking position BP and the projecting position, respectively. While the player is performing a music, the key 45 is assumed to be depressed, and the capstan button 44 pushes up the whippen assembly 41*d*. The stopper 43*g* is brought into contact with the stopper 43*h* before the repetition lever skin 41*m* comes into contact with the repetition regulating screw 42*f*, and the repetition lever 41*h* stops the upward motion. However, the jack 41*i* continues to push up the hammer roller 42*a*, and the hammer assembly 42 rotates in the clockwise direction.

When the toe 41*k* is brought into contact with the regulating button punching 43*o*, the jack 41*i* stops the upward motion, and, thereafter, the jack 41*i* escapes from the hammer assembly 42. As described hereinbefore, the gap between the toe 41*k* and the regulating button punching 43*o* is narrower than the standard value by about 1 millimeter, and the distance between the hammer head 42*e* and the strings 46 ranges from 5 millimeters to 7 millimeters at the escape. The hammer assembly 42 returns to 2 millimeters lower than the escaping point.

The hammer assembly 42 thus escaping from the jack 41*i* rushes toward the strings 46, and rebounds on one of the cushion members 43*u* before strike at the strings 46. Therefore, any acoustic sound is not produced through the vibrations of the strings, and the sound producing unit (not shown) may produce a synthesized tone.

The grand piano-like keyboard instrument behaves similar to a grand piano, and the key action mechanism 41 and the hammer assembly 42 give the unique key-touch to the player. However, detailed description is omitted for the sake of simplicity.

The rod member 43*s* and the cam member 43*d* may be driven by link mechanisms manipulated by a player.

Fourth Embodiment

Figure 20:
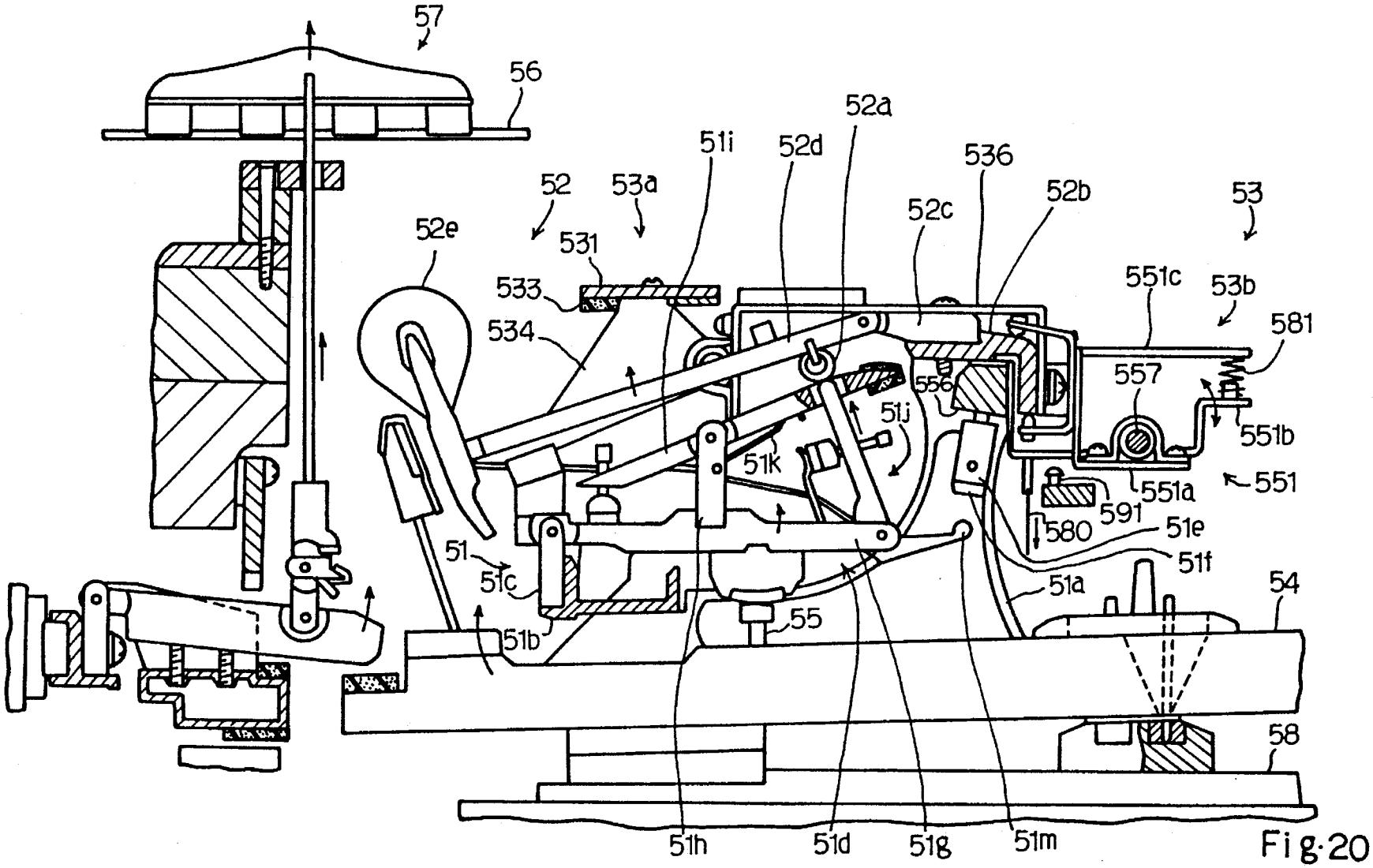
FIG. 20 is a partially cut-away side view showing essential parts of still another grand piano-like keyboard instrument according to the present invention.

Turning to FIG. 20 of the drawings, a key action mechanism 51 and a hammer mechanism 52 is incorporated in yet another grand piano-like keyboard instrument together with a mode controlling system 53. Of course, the key action mechanism 51 and the hammer mechanism 52 are associated with one of the keys 54 of a keyboard, and the other keys are also accompanied with the individual key action mechanisms 51 and the individual hammer mechanisms 52. The other components are similar to those of the first embodiment, and are not illustrated in FIG. 20 for the sake of simplicity.

Each of the key action mechanisms 51 is linked with a capstan button 55 of the key 54, and the associated hammer assembly 52 is provided for striking a set of strings 50 horizontally stretched over the key action mechanism 41. Although a damper mechanism 57 is further incorporated in the grand piano-like keyboard instrument, the damper mechanism 57 is analogous to that of a standard grand piano, and no description is made on the damper mechanism 57.

The key action mechanism 51 largely comprises an action bracket 51*a* fixed to a bracket block (not shown) mounted on a key bed 58, a whippen rail 51*b* expending over the keys and bolted to the action bracket 51*a*, a whippen flange 51*c* fixed to the whippen rail 51*b*, a whippen assembly 51*d* turnable around the whippen flange 51*c*, a regulating button 51*e* supported by the action bracket 51*a* and associated with the whippen assembly 41*d* and a regulating button punching 51*f* attached to the lower surface of the regulating button 51*e*.

The whippen assembly 41*d* comprises a whippen 51*g* swingably supported by the whippen flange 51*c*, a repetition lever flange 51*h* upright from the whippen 51*g*, a repetition lever 51*u* rockably supported by the repetition lever flange 51*h*, a jack 51*j* swingably supported by the leading end of the whippen 51*g* and a repetition spring 51*k* urging the repetition lever 51*i* in the counter clockwise direction, and the jack 51*j* is held in contact with a hammer roller 52*a* of the associated hammer assembly 52 while the key 54 is in the rest position.

The jack 51*j* has a toe 51*m* opposed to the regulating button punching 51*f*, and the gap between the toe 51*m* and the regulating button punching 51*f* is adjusted to a predetermined value.

If the key 54 is depressed, the whippen assembly 51*d* rotates in the counter clockwise direction, and the jack 51*j* pushes up the hammer roller 52*a* and, accordingly, the hammer assembly 52. When the toe 51*m* comes into contact with the regulating button punching 51*f*, the jack 51*j* stops the upward motion, and, then, kicks the hammer assembly 52. The hammer assembly 42 thus escaped from the jack 51*j* rushes toward the set of strings 57 at high speed, and rebounds on the strings 56 in the acoustic sound mode.

The hammer assembly 52 comprises a shank flange rail 52*b* bolted to the action bracket 51*a* and shared between the hammer assemblies, a shank flange 52*c* bolted to the shank flange rail 52*b*, a hammer shank 52*d* turnable around the shank flange 52*c*, the hammer roller 52*a* rotatably supported by the hammer shank 52*d* and a hammer head 52*e* fixed to the leading end of the hammer shank 52*d*.

Before the toe 51*m* comes into contact with the regulating button punching 51*f*, the hammer roller 52*a* is held in rolling contact with the jack 51*j*. However, when the jack 51*j* kicks the hammer roller 52*a*, the hammer assembly 52 is escaped from the jack 51*j*, and rushes toward the set of strings 56.

The mode controlling system 53 largely comprises a shank stopper 53*a* and a gap regulator 43*b* and a motor and actuator driver unit 43*c*, and cooperates with a sound producing unit (not shown) in an electronic sound producing sub-mode of the silent mode as similar to the first embodiment.

Figure 21:
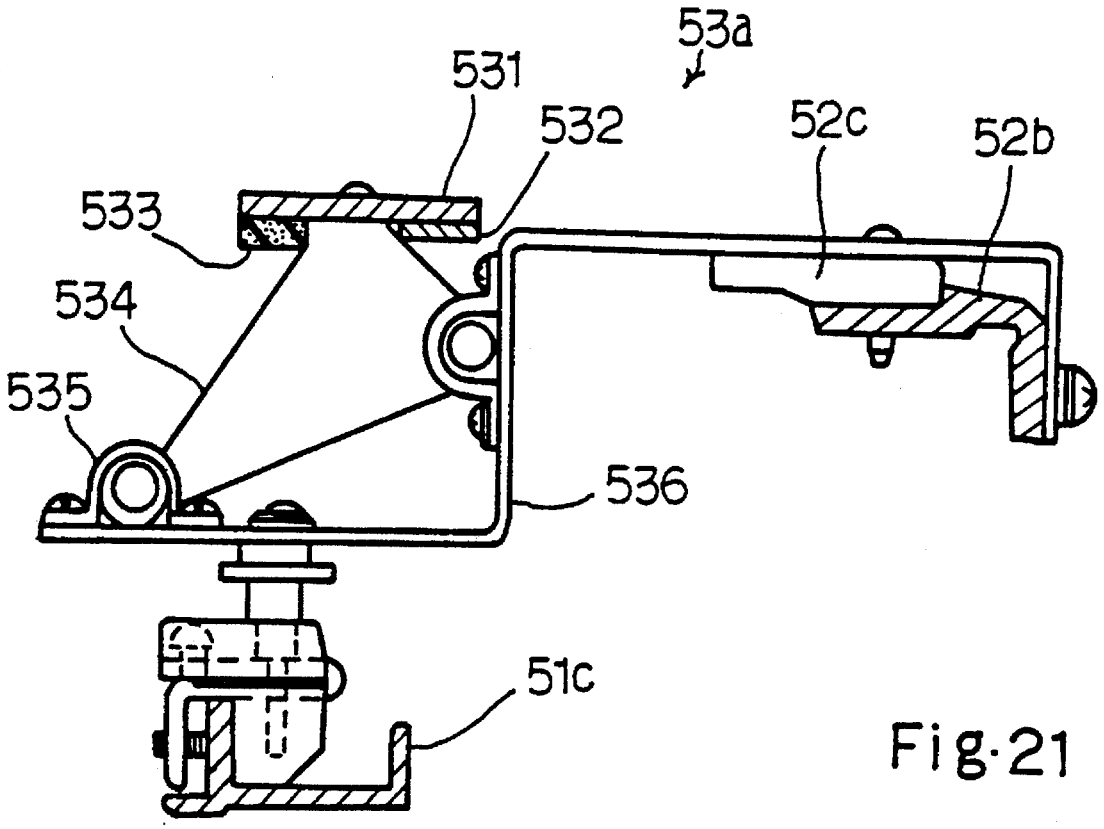
FIG. 21 is a partially cut-away side view showing the shank stopper shown in FIG. 21.
Figure 22:
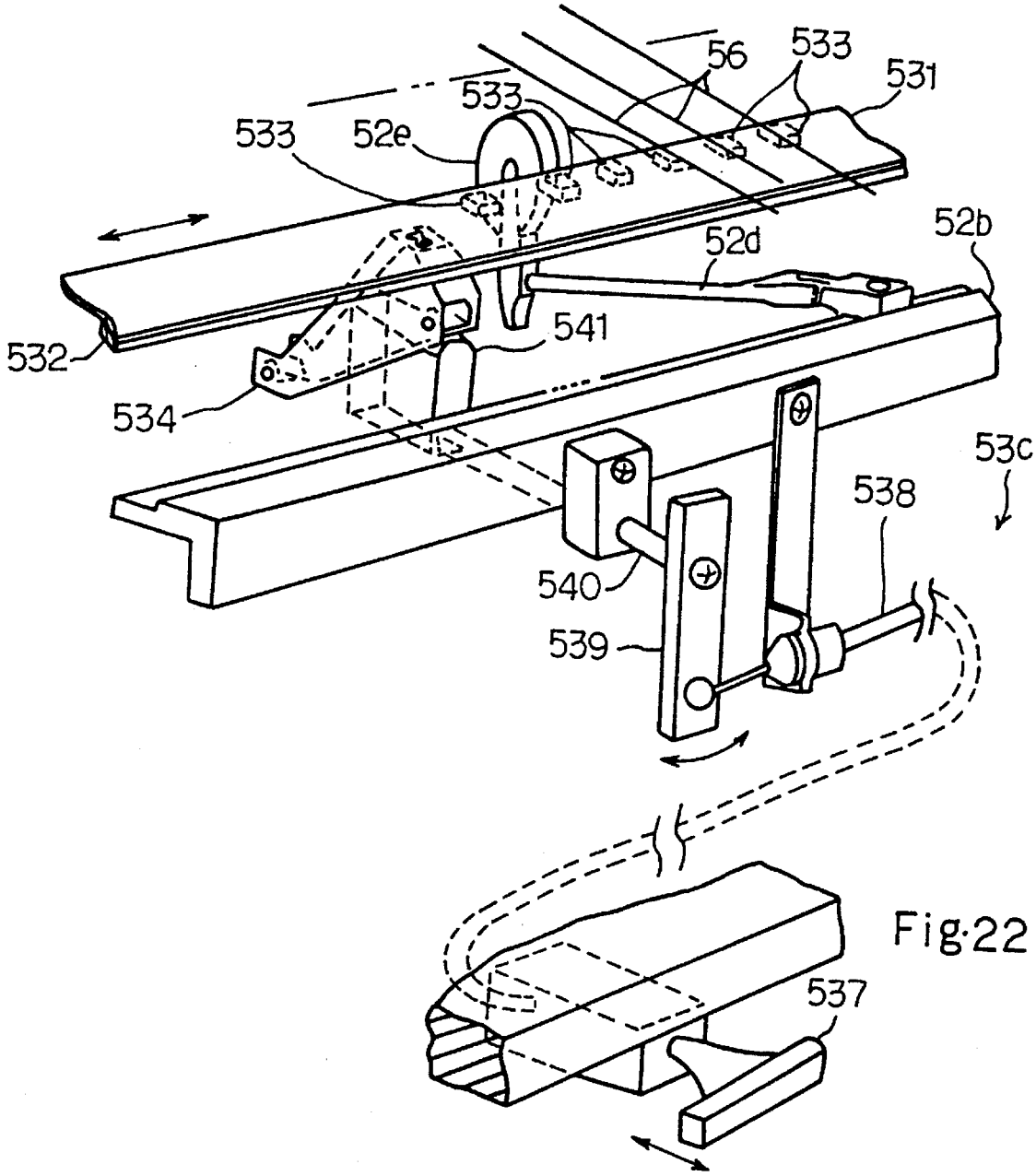
FIG. 22 is a perspective view showing a shank stopper incorproated in the grand piano-like keyboard instrument shown FIG. 20.

Turning to FIGS. 21 and 22, the shank stopper 53*a* comprises a stopper plate 531 extending over the hammer assemblies 52 reinforced by a rigid plate 532 and a plurality of cushion members 533 arranged at intervals and associated with the hammer shanks 52*d*, respectively, and the intervals are as narrow as the pitch of the hammer assemblies 52 regulated to 13 millimeters in this instance.

The shank stopper 53*a* further comprises five arm members 534 anchored to the lower surface of he stopper plate 531 at intervals, and a driving mechanism 53*c* laterally moves the stopper plate 531 depending upon the operation mode. The arm members at both ends of the stopper plate 531 are slidably supported by a journal units 535, and the journal units 535 are mounted on a bracket member 536.

While the grand piano-like keyboard instrument is in the acoustic sound mode, the driving mechanism 53*c* positions the gaps between the cushion members 533 over the shammer shanks 52*d*, and allows the hammer heads 52*e* to strike the associated sets of strings 56 without interruption of the cushion members 533.

On the other hand, if the grand piano-like keyboard instrument enters into the silent mode, the driving mechanism 53*c* shifts the stopper plate 531 so as to place the cushion members 533 over the hammer shanks 52*d*. As a result, when a player depresses the key 54, the hammer shank 52*d* is brought into contact with the associated cushion member 533 before the strike at the set of strings 56, and the set of strings 56 does not vibrate for producing an acoustic tone.

The driving mechanism 53*c* comprises a lever 537 manipulated by the player, a flexible wire 538 connected between the lever 537 and a rockable arm 539, a rod member 540 connected with the rockable arm 539 and a block member 541 loosely engaged with one of the arm members 534.

When the player pushes the lever 537, the wire 538 causes the rockable arm 539 to turn, and the rod member 540 rotates around the center axis thereof. As a result, the block member rightwardly pushes the arm member 534, and the stopper plate 531 changes the position.

If the player pulls the lever 537, the flexible wire 538 is retracted, and the rockable arm 539 turns in the counter clockwise direction. As a result, the block member 541 leftwardly pushes the stopper plate 531, and the cushion members 533 returns to the initial position.

Figure 23:
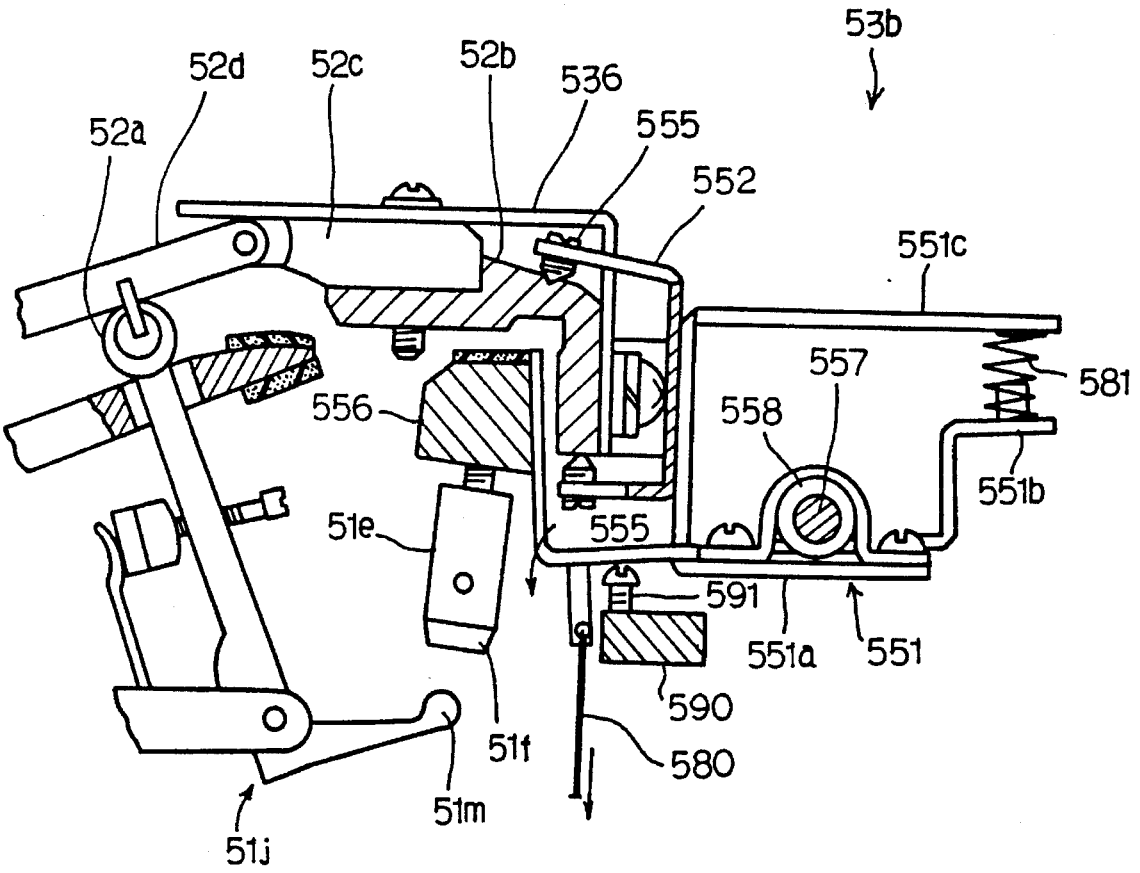
FIG. 23 is a partially cut-away side view showing a gap regulator incorporated in the grand piano-like keyboard instrument shown in FIG. 21.
Figure 24:
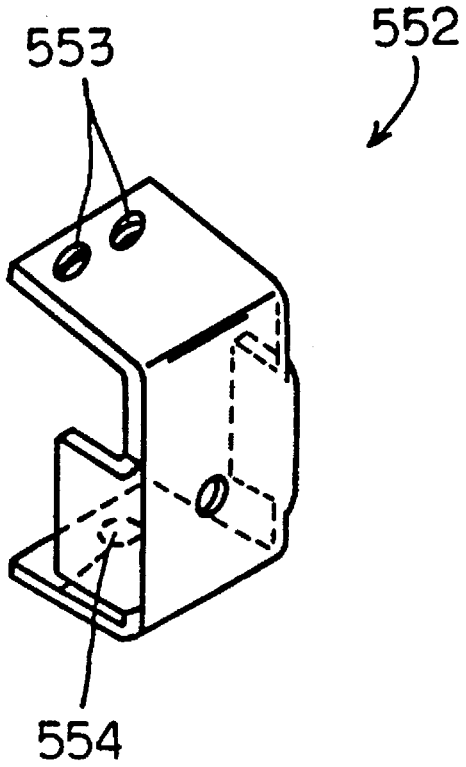
FIG. 24 is a perspective view showing a bracket member incorproated in the gap regulator.

Turning to FIG. 23 of the drawings, the gap regulator **53*b* is supported by a supporting structure 551, and the supporting structure 551 in turn is supported through a plurality of bracket members 552 by the shank flange rail 52*b*. As will be better seen from FIG. 24, holes 553 and 554 are formed in the upper and lower arms of the bracket member 552, and bolts 555 are screwed through the holes 553 and 554 into the shank flange rail 52*b***.

The gap regulator **53*b* comprises a regulating rail member 556 split into a plurality of blocks, 5561 to 556*n* and a rotational rod member 557 rotatably supported by journal units 558 mounted on the supporting structure 551, and the rotational rod member 557 is imaginary split into a plurality of sections 5571 to 557*n* respectively assigned to the blocks 5561 to 556*n*. The regulating buttons 51*e* are grouped into blocks respectively corresponding to the blocks 5561 to 556*n*, and are fixed to the associated blocks 5561 to 556*n*, respectively. The gaps between the regulating button punching 51*f* and the toes 51*m* are regulated to 3 to 5 millimeters, and allows the jacks 51*j* to escape from the hammer assemblies 52 at the distance of 2 to 3 millimeters between the hammer heads 52*e* and the strings 56 in the acoustic sound mode. However, the gaps between the ties 51*m* and the regulating button punching 51*f* are decreased to 1 to 3 millimeters in the silent mode, and allow the jacks 51*k* to escape from the associated hammer assemblies 52 at the distance ranging from 8 to 15 millimeters. Since the regulating buttons 51*e* is screwed into the regulating rail member 556**, the gaps are easily regulable.

Figure 25:
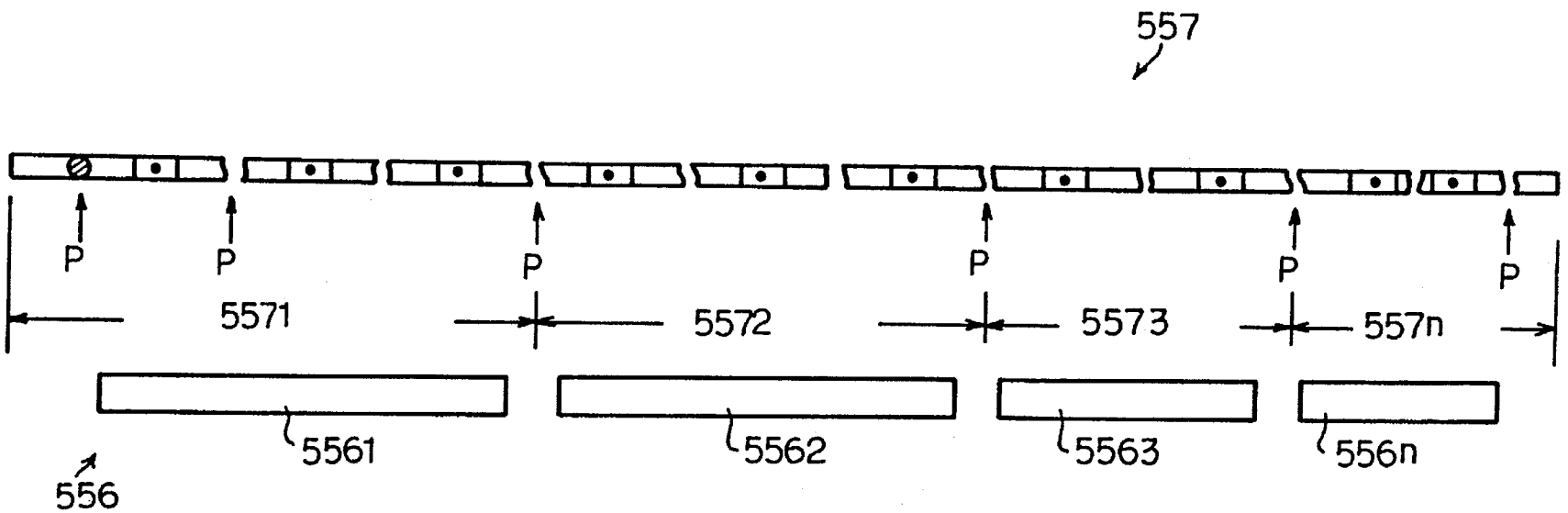
FIG. 25 is a front view showing a rod member incorproated in a gap regulator.
Figure 26:
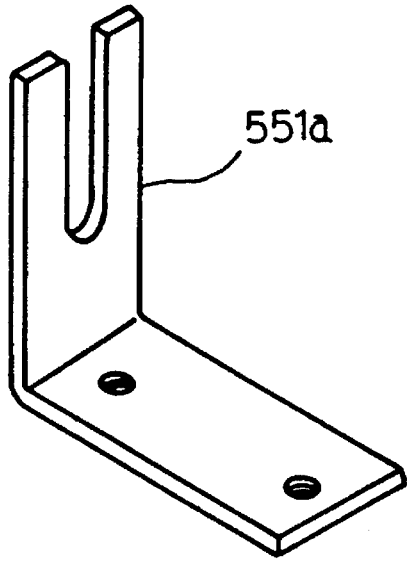
FIG. 26 is a perspective view showing another bracket member incorporated in the gap regulator.
Figure 27:
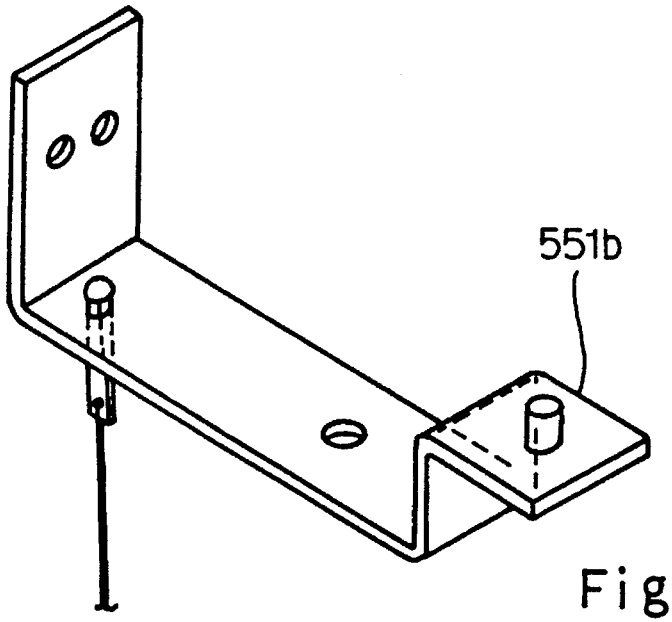
FIG. 27 is perspective view showing a yet another bracket incorporated in the gap regulator.
Figure 28:
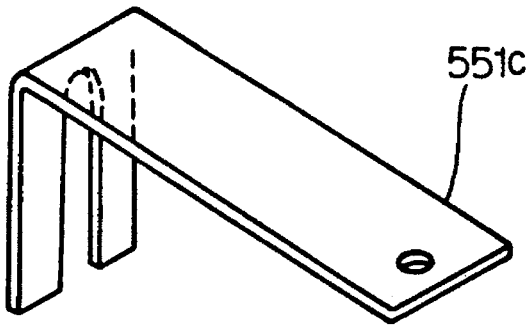
FIG. 28 is a perspective view showing a still another bracket member incorporated in the gap regulator.

The bracket members 552 are provided at sixteen points P as shown in FIG. 25, and the supporting structure 551 is fabricated from generally L-shaped bracket members **551*a* shown in FIG. 26 and also positioned at P for mounting the journal units 558, a plurality of generally channel shaped bracket members 5551 fixed to the blocks 5561 to 556*n* of the regulating rail member 556 and a plurality of generally inverted L-shaped bracket members 551*c* shown in FIG. 27. The rod members 557 is banded to the generally channel-shaped bracket members 551*b*, and is rotatable together with the bracket members 551*b***.

A flexible wire 580 is anchored at the generally channel-shaped bracket members **551*b*, and the flexible wire 580 is terminated at the lever 537 of the driving mechanism 53*c*. Therefore, the driving mechanism 53*c* is shared between the shank stopper 53*a* and the gap regulator 53*b*, and the player can simultaneously changes the shank stopper 53*a* and the gap regulator 53*b***.

The gap regulator **53*b* further comprises a spring member 581 inserted between the bracket members 551*b* and 551*c*, and the spring member 581 urges the generally channel-shaped bracket members 551*b* in the clockwise direction. Therefore, the generally channel-shaped bracket members 551*b*, the rod member 557 and, accordingly, the regulating rail member 556 are urged in the clockwise direction, and increase the gaps between the regulating button punching 51*f* and the toes 51*m***.

The gap regulator **53*b* further comprises a stationary rail member 590 and stoppers 591 projecting from the stationary rail member 590. When the flexible wire 580 is pulled down, the stoppers 591 restrict the downward motion of the bracket members 551*b***.

Description is hereinbelow made on the acoustic sound mode and the silent mode. First, if the player pushes the lever 537, the driving mechanism **53*c* places the cushion members 533 between the hammer shanks 52*d*, and allows the spring member 581 to pull up the regulating button punching 51*f*. While the player is performing a music, the key 54 is assumed to be depressed, the capstan button 55 pushes up the whippen assembly 51*d*, and the jack 51*j* lifts the hammer assembly 52. When the toe 51*m* is brought into contact with the regulating button punching 51*f*, the jack 51*j* stops the upward motion, and the jack 51*j* escapes from the hammer assembly 52. The hammer head 52*e* rushes toward the set of strings 56, and rebounds thereon. The strings 56** vibrate, and produce an acoustic sound.

Thus, the jack **51*j* escapes from the hammer assembly 52** at the same timing as a standard grand piano, and gives the unique key-touch to the player.

On the other hand, if the player pulls the lever 537, the stopper plate 531 causes the cushion members 533 to place over the hammer shanks **52*d*, respectively, and the flexible wire 580 pulls down the bracket members 551*b* and the regulating rail member 556 against the elastic force of the spring member 581. As a result, the grand piano-like keyboard instrument enters into the silent mode, and the regulating button punching 51*f* becomes closer to the associated toes 51*m***.

While the player is performing a music in the silent mode, the key 54 is also assumed to be depressed. The capstan button 55 pushes up the whippen assembly **51*d*, and the jack rotates the hammer assembly in the colockwise direction. When the toe 51*m* is brought into contact with the regulating button punching 51*f* earlier than the acoustic sound mode, the jack 51*j* stops the upeard motion, and kicks the hammer assembly 52 before the hammer shank 52*d* comes into contact with the cushion member 533**.

Then, the hammer assembly 52 is driven for rotation at high speed, and strikes the assoicated set of strings 56 without interruption of the cushion member 531. Thus, the strings 56 does not vibrate in the silent mode, and a sound producing unit may produce a synthesized tone instead of the acoustic sound.

As will be appreciated from the foregoing descirption, the mode controlling system accoding to the present invention gives piano key-touch to a player in both acoustic and silent modes, and the player can confirm the tones through a headphone in the silent mode.

Figure 29:
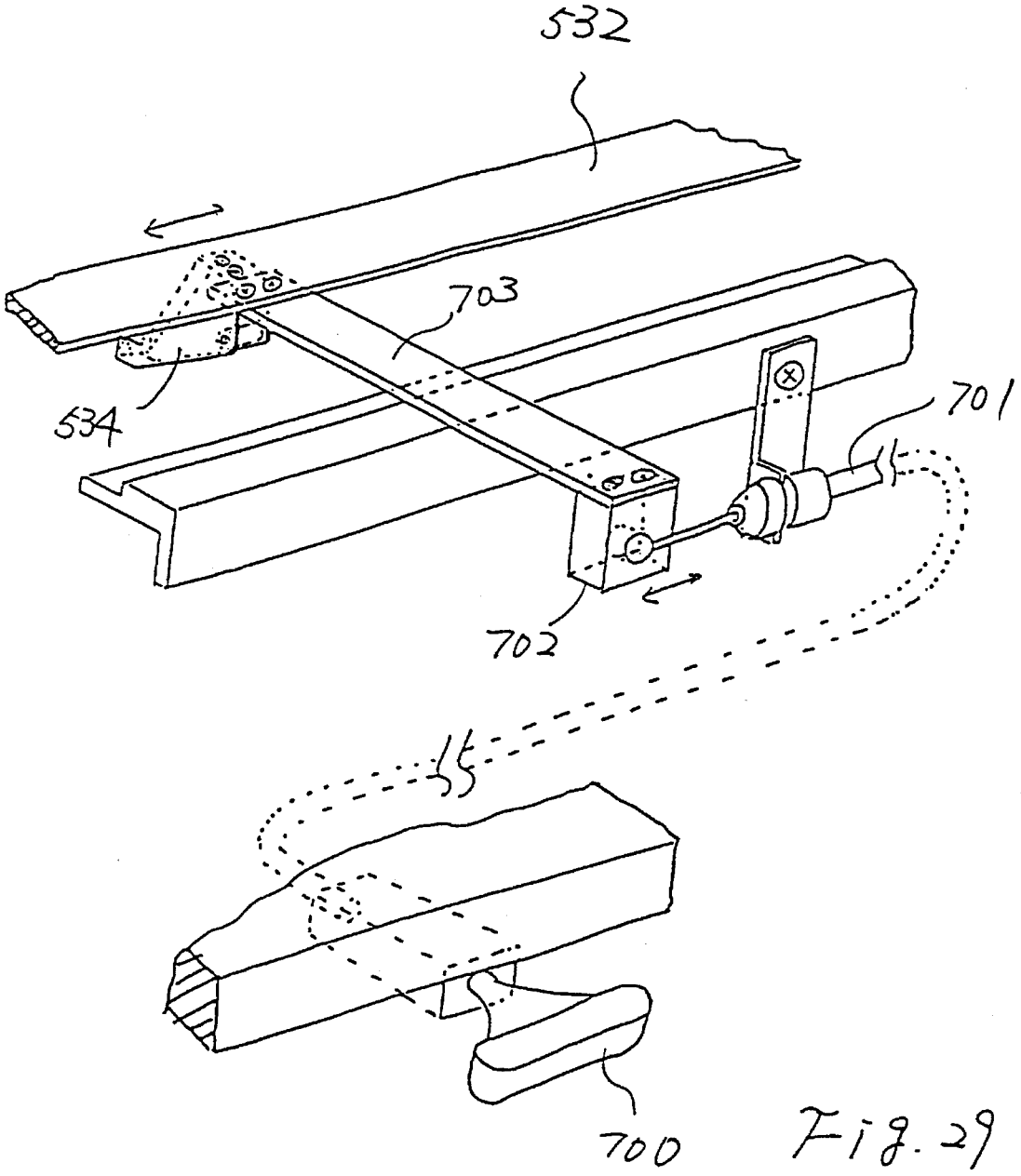
FIG. 29 is a perspective view showing another driving mechanism for the shank stopper.

FIG. 29 shows another driving mechanism replaceable with the driving mechanism **53*c*, and comprises a lever 700, a flexible wire 701, a bracket member 702 attached to the leading end of the flexible wire 701, a plate member 703 conected between the bracket member 702 and the stopper plate 531. The lever 700 is manipulated by a player, and the driving mechanism laterally moves the stopper plate 531. The flexible wire 580 is also connected with the lever 700, and the driving mechanism shifts not only the shank stopper 53*a* but also the gap regulator 53*b***.

Although particular embodiments of the present invention have been shown and described, it will be obvious to those skilled in the art that various changes and modifications may be made without departing from the spirit and scope of the present invention. For example, extensions may be attached to the hammer shanks or the hammer heads and brought into contact with a shank stopper in a silent mode. The extensions may remodel a grand piano to a grand-piano like keyboard instrument according to the present invention.

What is claimed is:

1. A keyboard instrument selectively entering an acoustic sound producing mode and an electronic sound producing mode, comprising:

a) a grand piano including a stationary board member mounted thereon, the grand piano further comprising:

a-1) a keyboard having a plurality of keys turnable with respect to the stationary board member, said plurality of keys being selectively depressed in both acoustic and electronic sound producing modes by a player, a-2) a plurality of key action mechanisms, each of which is respectively coupled with one of said plurality of keys, and is selectively actuated by said one of said plurality of keys when said player depresses said one key, each of said plurality of key action mechanisms having:

an action bracket stationary with respect to said stationary board member, a whippen assembly coupled with said one of said plurality of keys for rotation around one end thereof with respect to said action bracket, a repetition lever flange projecting from an intermediate portion of the whippen assembly, a repetition lever swingably supported by said repetition lever flange and having a through-hole formed in one end portion thereof, a jack rotatably supported by an end portion of said whippen assembly and having a toe and a contact portion projecting through said through-hole, a regulating button supported by said action bracket and opposed to said toe, and a repetition spring coupled with said repetition lever for urging said repetition lever in a direction to increase a gap between said one end portion of said repetition lever and said end portion of said whippen assembly, a-3) a plurality of hammer mechanisms each of which is coupled with a respective one of the key action mechanisms, and each having a hammer head and a hammer shank, wherein each said hammer head is connected with a respective one of the hammer shanks and wherein:

each said hammer mechanism is driven for rotation by the respective one of said key action mechanisms to which it is coupled when said player selectively depresses said one key that is coupled with the respective one of said key action mechanisms; and each said hammer shank of each said hammer mechanism being swingably supported by said action bracket of the respective one of said key action mechanisms and held in contact with said contact portion of said jack of the respective one of said key action mechanisms to which each said hammer mechanism is coupled while said one key that is coupled with said respective one of said key action mechanisms is in a rest position, a-4) a plurality of sets of strings associated with said plurality of hammer mechanisms, and stretched over said plurality of key action mechanisms, at least one of said sets of strings being struck by one of the hammer heads in said acoustic sound producing mode when the player selectively depresses said one of said plurality of keys;

b) a stopper means entering into a free position in said acoustic sound mode for allowing at least one of said plurality of hammer heads to strike at least one of said sets of strings when said player depresses at least one of said plurality of keys, and said stopper means entering into a blocking position in said electronic sound producing mode for blocking said plurality of sets of strings from said hammer heads when said player selectively depresses said keys;

c) a gap regulating means between at least one of said regulating buttons and at least one of said toes for changing the gap therebetween; and d) an electronic sound producing means monitoring said plurality of keys to determine which keys are depressed by said player in said electronic sound producing mode, and operative to electronically produce sounds corresponding to the keys depressed by said player;

wherein:

said stopper means comprises a rotatable rod and a cushion member attached to the rotatable rod, said cushion member being opposed to said hammer shank of each of the plurality of hammer mechanisms when the stopper means is in said blocking position, and said gap regulating means comprises:

an upper rail member fixed to each of said action brackets, a lower rail member connected with each of said regulating buttons, spring means coupled between said upper rail member and said lower rail member for urging said lower rail member towards said upper rail member, a wedge means slidably inserted between said upper rail member and said lower rail member, and an actuator connected with said wedge means, and moving said wedge means between a retracted position in said acoustic sound mode and a projecting position in said electronic sound producing mode.

2. The keyboard instrument as set forth in claim 1 wherein:

said keyboard instrument comprises apparatus for producing high, middle and low pitch tones, depending upon which of said plurality of keys is selectively depressed by said player;

the plurality of key action mechanisms include at least one key action mechanism for said high-pitch tones, at least one key action mechanism for said middle-pitch tones and at least one key action mechanism for said low-pitch tones; and said wedge means comprises at least one wedge member wherein at least one of said at least one wedge member is respectively associated with each of: said at least one key action mechanism for high-pitch tones, said at least one key action mechanism for middle-pitch tones and said at least one key action mechanism for low-pitch tones.

3. A keyboard instrument selectively entering an acoustic sound producing mode and an electronic sound producing mode, comprising:

a) a grand piano including a stationary board member mounted thereon, the grand piano further comprising:

a-1) a keyboard having a plurality of keys turnable with respect to the stationary board member, said plurality of keys being selectively depressed in both acoustic and electronic sound producing modes by a player, a-2) a plurality of key action mechanisms, each of which is respectively coupled with one of said plurality of keys, and is selectively actuated by said one of said plurality of keys when said player depresses said one key, each of said plurality of key action mechanisms having:

an action bracket stationary with respect to said stationary board member, a whippen assembly coupled with said one of said plurality of keys for rotation around one end thereof with respect to said action bracket, a repetition lever flange projecting from an intermediate portion of the whippen assembly, a repetition lever swingably supported by said repetition lever flange and having a through-hole formed in one end portion thereof, a jack rotatably supported by an end portion of said whippen assembly and having a toe and a contact portion projecting through said through-hole, a regulating button supported by said action bracket and opposed to said toe, and a repetition spring coupled with said repetition lever for urging said repetition lever in a direction to increase a gap between said one end portion of said repetition lever and said end portion of said whippen assembly, a-3) a plurality of hammer mechanisms each of which is coupled with a respective one of the key action mechanisms, and each having a hammer head and a hammer shank, wherein each said hammer head is connected with a respective one of the hammer shanks and wherein:

each said hammer mechanism is driven for rotation by the respective one of said key action mechanisms to which it is coupled when said player selectively depresses said one key that is coupled with the respective one of said key action mechanisms; and each said hammer shank of each said hammer mechanism being swingably supported by said action bracket of the respective one of said key action mechanisms and held in contact with said contact portion of said jack of the respective one of said key action mechanisms to which each said hammer mechanism is coupled while said one key that is coupled with said respective one key of said action mechanisms is in a rest position, a-4) a plurality of sets of strings associated with said plurality of hammer mechanisms, and stretched over said plurality of key action mechanisms, at least one of said sets of strings being struck by one of the hammer heads in said acoustic sound producing mode when the player selectively depresses said one of said plurality of keys;

b) a stopper means entering into a free position in said acoustic sound mode for allowing at least one of said plurality of hammer heads to strike at least one of said sets of strings when said player depresses at least one of said plurality of keys, and said stopper means entering into a blocking position in said electronic sound producing mode for blocking said plurality of sets of strings from said hammer heads when said player selectively depresses said keys;

c) a gap regulating means between at least one of said regulating buttons and at least one of said toes for changing the gap therebetween; and d) an electronic sound producing means monitoring said plurality of keys to determine which keys are depressed by said player in said electronic sound producing mode, and operative to electronically produce sounds corresponding to the keys depressed by said player;

wherein:

said stopper means comprises a rotatable rod and a cushion member attached to the rotatable rod, said cushion member being opposed to said hammer shank of each of the plurality of hammer mechanisms when the stopper means is in said blocking position, and said gap regulating means comprises:

a guide member fixed to said action bracket, a bracket member slidably supported on said guide member, a plurality of spacer plates attached to a leading end portion of said bracket member wherein each of the spacer plates has a lower surface, a plurality of cushion sheets attached to the lower surfaces of said plurality of spacer plates, and an actuator operative to retract each of said plurality of spacer plates and each of said plurality of cushion sheets from between said toe and said regulating button in said acoustic sound mode and to project each of said plurality of spacer plates and each of said plurality of cushion sheets to between said toe and said regulating button in said electronic sound producing mode.

4. The keyboard instrument as set forth in claim 3, in which a lubricant sheet is attached to said guide member so that said bracket member smoothly slides on said lubricant sheet.

5. A keyboard instrument selectively entering an acoustic sound producing mode and an electronic sound producing mode, comprising:

a) a grand piano including a stationary board member mounted thereon, the grand piano further comprising:

a-1) a keyboard having a plurality of keys turnable with respect to the stationary board member, said plurality of keys being selectively depressed in both acoustic and electronic sound producing modes by a player, a-2) a plurality of key action mechanisms, each of which is respectively coupled with one of said plurality of keys, and is selectively actuated by said one of said plurality of keys when said player depresses said one key, each of said plurality of key action mechanisms having:

an action bracket stationary with respect to said stationary board member, a whippen assembly coupled with said one of said plurality of keys for rotation around one end thereof with respect to said action bracket, a repetition lever flange projecting from an intermediate portion of the whippen assembly, a repetition lever swingably supported by said repetition lever flange and having a through-hole formed in one end portion thereof, a jack rotatably supported by an end portion of said whippen assembly and having a toe and a contact portion projecting through said through-hole, a regulating button supported by said action bracket and opposed to said toe, and a repetition spring coupled with said repetition lever for urging said repetition lever in a direction to increase a gap between said one end portion of said repetition lever and said end portion of said whippen assembly, a-3) a plurality of hammer mechanisms each of which is coupled with a respective one of the key action mechanisms, and each having a hammer head and hammer shank wherein each said hammer head is connected with a respective one of the hammer shanks and wherein:

each said hammer mechanism is driven for rotation by the respective one of said key action mechanisms to which it is coupled when said player selectively depresses said one key that is coupled with the respective one of said key action mechanisms; and each said hammer shank of each said hammer mechanism being swingably supported by said action bracket of the respective one of said key action mechanisms and held in contact with said contact portion of said jack of said respective one of said key action mechanisms to which each said hammer mechanism is coupled while said one key that is coupled with said respective one of said key action mechanisms is in a rest position, a-4) a plurality of sets of strings associated with said plurality of hammer mechanisms, and stretched over said plurality of key action mechanisms, at least one of said sets of strings being struck by one of the hammer heads in said acoustic sound producing mode when the player selectively depresses said one of said plurality of keys;

b) a stopper means entering into a free position in said acoustic sound mode for allowing at least one of said plurality of hammer heads to strike at least one of said sets of strings when said player depresses at least one of said plurality of keys, and said stopper means entering into a blocking position in said electronic sound producing mode for blocking said plurality of sets of strings from said hammer heads when said player selectively depresses said keys;

c) a gap regulating means between at least one of said regulating buttons and at least one of said toes for changing the gap therebetween; and d) an electronic sound producing means monitoring said plurality of keys to determine which keys are depressed by said player in said electronic sound producing mode, and operative to electronically produce sounds corresponding to the keys depressed by said player;

wherein:

said stopper means comprises a rotatable rod and a cushion member attached to the rotatable rod, said cushion member being opposed to said hammer shank of each of the plurality of hammer mechanisms when the stopper means is in said blocking position, and said gap regulating means comprises:

a cam member having hill positions and valley portions, and laterally slidable with respect to said action bracket, leaf spring means connected with said action bracket, and deformed by said cam member, a regulating rail member attached to said leaf spring means, and hanging each of said at least one of said regulating buttons, a repetition regulating screw attached to said respective one of said hammer assemblies, a repetition lever skin attached to said repetition lever and opposed to said repetition regulating screw, a first stopper connected with said repetition lever, a second stopper connected with said regulating rail member, and opposed to said first stopper, a gap between said first and second stoppers being not greater than a gap between the repetition regulating screw and the repetition lever skin while the one key that is coupled with the respective one of said key action mechanisms having the at least one of said regulating buttons is maintained at said rest position in said acoustic sound mode, and an actuator operative to laterally move said cam member so that one of said hill positions comes into contact with said leaf spring means in said electronic sound producing mode, said actuator allowing one of said valley portions to come into contact with said leaf spring means in said silent mode for changing the gap between said at least one of said toes and said at least one of said regulating buttons, said gap between said first and second stoppers being less than said gap between said repetition regulating screw and said repetition lever skin in said electronic sound producing mode.

6. A keyboard instrument selectively entering an acoustic sound producing mode and an electronic sound producing mode, comprising:

a) a grand piano including a stationary board member mounted thereon, the grand piano further comprising:

a-1) a keyboard having a plurality of keys turnable with respect to the stationary board member, said plurality of keys being selectively depressed in both acoustic and electronic sound producing modes by a player, a-2) a plurality of key action mechanisms, each of which is respectively coupled with one of said plurality of keys, and is selectively actuated by said one of said plurality of keys when said player depresses said one key, each of said plurality of key action mechanisms having:

an action bracket stationary with respect to said stationary board member, a whippen assembly coupled with said one of said plurality of keys for rotation around one end thereof with respect to said action bracket, a repetition lever flange projecting from an intermediate portion of the whippen assembly, a repetition lever swingably supported by said repetition lever flange and having a through-hole formed in one end portion thereof, a jack rotatably supported by an end portion of said whippen assembly and having a toe and a contact portion projecting through said through-hole, a regulating button supported by said action bracket and opposed to said toe, and a repetition spring coupled with said repetition lever for urging said repetition lever in a direction to increase a gap between said one end portion of said repetition lever and said end portion of said whippen assembly, a-3) a plurality of hammer mechanisms each of which is coupled with a respective one of the key action mechanisms, and each having a hammer head and hammer shank wherein each said hammer head is connected with a respective one of the hammer shanks and wherein:

each said hammer mechanism is driven for rotation by the respective one of said key action mechanisms to which it is coupled when said player selectively depresses said one key that is coupled with the respective one of said key action mechanisms; and each said hammer shank of each said hammer mechanism being swingably supported by said action bracket of the respective one of said key action mechanisms and held in contact with said contact portion of said jack of the respective one of said key action mechanisms to which each said hammer mechanism is coupled while said one key that is coupled with said respective one of said key action mechanisms is in a rest position, a-4) a plurality of sets of strings associated with said plurality of hammer mechanisms, and stretched over said plurality of key action mechanisms, at least one of said sets of strings being struck by one of the hammer heads in said acoustic sound producing mode when the player selectively depresses said one of said plurality of keys;

b) a stopper means entering into a free position in said acoustic sound mode for allowing at least one of said plurality of hammer heads to strike at least one of said sets of strings when said player depresses at least one of said plurality of keys, and said stopper means entering into a blocking position in said electronic sound producing mode for blocking said plurality of sets of strings from said hammer heads when said player selectively depresses said keys;

c) a gap regulating means between at least one of said regulating buttons and at least one of said toes for changing the gap therebetween; and d) an electronic sound producing means monitoring said plurality of keys to determine which keys are depressed by said player in said electronic sound producing mode, and operative to electronically produce sounds corresponding to the keys depressed by said player;

wherein:

said stopper means comprises:

a slidable plate member provided over said plurality of hammer mechanisms, wherein the slidable plate member includes a lower surface, a plurality of spatially separated cushion members attached to the lower surface of said slidable plate member, and a first driving means operative to shift said slidable plate member between said acoustic sound mode and said electronic sound producing mode, said plurality of cushion members being opposed to the hammer shanks of said plurality of hammer mechanisms in said electronic sound producing mode, gaps between said plurality of cushion members being opposed to said hammer shanks in said acoustic sound mode, and said gap regulating means comprises:

a plurality of first bracket members stationary with respect to said stationary board member, a plurality of second bracket members angularly movable with respect to said plurality of first bracket members, a plurality of third bracket members stationary with respect to said plurality of first bracket members and fixed to said plurality of second bracket members, a rod member journaled by the plurality of third bracket members, a regulating rail member supported by said plurality of second bracket members, and hanging each of said at least one of said regulating buttons, a spring means inserted between said plurality of first bracket members and said plurality of second bracket members, and urging said plurality of second bracket members toward said plurality of first bracket members, a stopper means provided under said regulating rail member for restricting a downward motion thereof, and a second driving means operative to pull down said regulating rail member against elastic force of said spring means in said electronic sound producing mode, said second driving means allowing said spring means to pull up said regulating rail member in said acoustic sound mode.

7. The keyboard instrument as set forth in claim 6, in which a link mechanism serves as said first and second driving means.

* * * * *